US010145238B2

(12) United States Patent
Lines

(10) Patent No.: US 10,145,238 B2
(45) Date of Patent: Dec. 4, 2018

(54) AUTOMATIC ADJUSTMENT OF MAGNETOSTRICTIVE TRANSDUCER PRELOAD FOR ACOUSTIC TELEMETRY IN A WELLBORE

(71) Applicant: Halliburton Energy Services, Inc., Houston, TX (US)

(72) Inventor: Richard Lines, Worcestershire (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/556,947

(22) PCT Filed: Apr. 22, 2015

(86) PCT No.: PCT/US2015/027005

§ 371 (c)(1),
(2) Date: Sep. 8, 2017

(87) PCT Pub. No.: WO2016/171679

PCT Pub. Date: Oct. 27, 2016

(65) Prior Publication Data

US 2018/0051557 A1 Feb. 22, 2018

(51) Int. Cl.
*E21B 47/16* (2006.01)

(52) U.S. Cl.
CPC ..... *E21B 47/16* (2013.01)

(58) Field of Classification Search
CPC ..... E21B 47/12; E21B 47/14; E21B 47/16
See application file for complete search history.

(56) References Cited

U.S. PATENT DOCUMENTS

| | | | |
|---|---|---|---|
| 2,745,998 | A | 5/1956 | McPherson, Jr. |
| 3,906,434 | A | 9/1975 | Lamel |
| 4,254,481 | A | 3/1981 | Smither et al. |
| 4,975,643 | A | 12/1990 | Buchwald et al. |

(Continued)

FOREIGN PATENT DOCUMENTS

| | | |
|---|---|---|
| WO | 9304349 | 3/1993 |
| WO | 2014100276 | 6/2014 |

OTHER PUBLICATIONS

Dhilsha et al., "Advanced Magnetostrictive Materials for Sonar Applications", Jan. 1, 2005, 7 pages.

(Continued)

*Primary Examiner* — Ryan Sherwin
(74) *Attorney, Agent, or Firm* — Kilpatrick Townsend & Stockton LLP

(57) ABSTRACT

A magnetostrictive transducer system included as part of a drill string for use downhole in a well to convey signals across regions of the drill string that preclude the use of wired communication elements. The magnetostrictive transducer conveys a carrier signal as an acoustic wave through a drill collar region to an acoustic telemetry receiver, which passes an output both to an uphole processing system and back into the magnetostrictive transducer system. The output signal and carrier signal are compared to determine sub-harmonics or higher order harmonics of the output or carrier signal indicative of offset in the magnetostrictive core of the magnetostrictive transducer system, and provides a corrective component signal to automatically adjust the magnetostrictive core though preloading forces.

22 Claims, 13 Drawing Sheets

(56) References Cited

U.S. PATENT DOCUMENTS

| | | | | |
|---|---|---|---|---|
| 5,020,036 | A | 5/1991 | Petermann et al. | |
| 5,039,894 | A | 8/1991 | Teter et al. | |
| 5,076,100 | A | 12/1991 | Hunter et al. | |
| 5,568,448 | A * | 10/1996 | Tanigushi | B06B 1/08 175/40 |
| 5,675,325 | A | 10/1997 | Taniguchi et al. | |
| 5,804,961 | A | 9/1998 | Castillo et al. | |
| 6,272,916 | B1 | 8/2001 | Taniguchi et al. | |
| 6,912,177 | B2 | 6/2005 | Smith et al. | |
| 6,998,999 | B2 | 2/2006 | Fripp et al. | |
| 7,612,473 | B2 | 11/2009 | Suzuki et al. | |
| 9,070,856 | B1 * | 6/2015 | Rose | H01L 41/042 |
| 2002/0039328 | A1 * | 4/2002 | Dubinsky | E21B 47/16 367/82 |
| 2005/0264349 | A1 | 12/2005 | Williams et al. | |
| 2011/0056750 | A1 | 3/2011 | Lucon et al. | |
| 2012/0111633 | A1 | 5/2012 | Kumar et al. | |
| 2012/0132416 | A1 | 5/2012 | Zolezzi-Garreton et al. | |
| 2013/0257629 | A1 | 10/2013 | Hallundbæk et al. | |

OTHER PUBLICATIONS

International Patent Application No. PCT/US2015/027005 , "International Search Report and Written Opinion", dated Nov. 17, 2015, 9 pages.

* cited by examiner

AUTOMATIC ADJUSTMENT OF MAGNETOSTRICTIVE TRANSDUCER PRELOAD FOR ACOUSTIC TELEMETRY IN A WELLBORE

TECHNICAL FIELD

This disclosure relates to apparatus and systems for the wireless acoustic transmission of signal with a magnetostrictive transducer for use with a tool string drilling system, or other such well system tool string systems, deployed in hydrocarbon wells and other wells.

BACKGROUND

In some well system applications, the use of wireline or slickline communication connections across certain regions of a tool string is not ideal or not feasible. One approach to transmitting signal downhole without wires is the use of an acoustic link, where a magnetostrictive transducer is used to transmit a sound wave into the metal of the tool string which then propagates along the tool string and is received by a sensor elsewhere on the tool string. In many drilling applications, however, the vibration and motion of the drilling apparatus at the end of a tool string can cause noise or interference with the acoustic signals physically transmitted through the tool string.

BRIEF DESCRIPTION OF THE DRAWINGS

Illustrative aspects of the present disclosure are described in detail below with reference to the following drawing figures.

FIG. 1-2 is a schematic diagram of a well system tool string deployed in a wellbore, having a magnetostrictive transducer and an acoustic telemetry receiver, according to some aspects of the present disclosure.

FIG. 2 is a schematic illustration of a magnetostrictive transducer, according to some aspects of the present disclosure.

FIG. 7-1 is a graph of the strain response of a magnetostrictive core in response to a coercive force from a magnetic field, with no preload force acting on the magnetostrictive core, according to some aspects of the present disclosure.

FIG. 7-2 is a graph of the strain response of a magnetized magnetostrictive core in response to a coercive force from a magnetic field, with a preload force acting on the magnetostrictive core to set the magnetostrictive core at an equilibrium working point, according to some aspects of the present disclosure.

FIG. 7-3 is a graph of the strain response of a magnetized magnetostrictive core in response to a coercive force from a magnetic field, with an insufficient preload force acting on the magnetostrictive core thereby setting the magnetostrictive core below an equilibrium working point, according to some aspects of the present disclosure.

FIG. 7-4 is a graph of the strain response of a magnetized magnetostrictive core in response to a coercive force from a magnetic field, with an excessive preload force acting on the magnetostrictive core thereby setting the magnetostrictive core above an equilibrium working point, according to some aspects of the present disclosure.

FIG. 9-1 is a graph of the strain response of a non-magnetized magnetostrictive core in response to a coercive force from a magnetic field, with a preload force acting on the magnetostrictive core to set the magnetostrictive core at a baseline working point, according to some aspects of the present disclosure.

FIG. 9-2 is a graph of the strain response of a non-magnetized magnetostrictive core in response to a coercive force from a magnetic field, where a negative magnetic field has shifted the magnetostrictive core away from a baseline working point, according to some aspects of the present disclosure.

FIG. 9-3 is a graph of the strain response of a non-magnetized magnetostrictive core in response to a coercive force from a magnetic field, where a positive magnetic field has shifted the magnetostrictive core away from a baseline working point, according to some aspects of the present disclosure.

DETAILED DESCRIPTION

Figure 1:
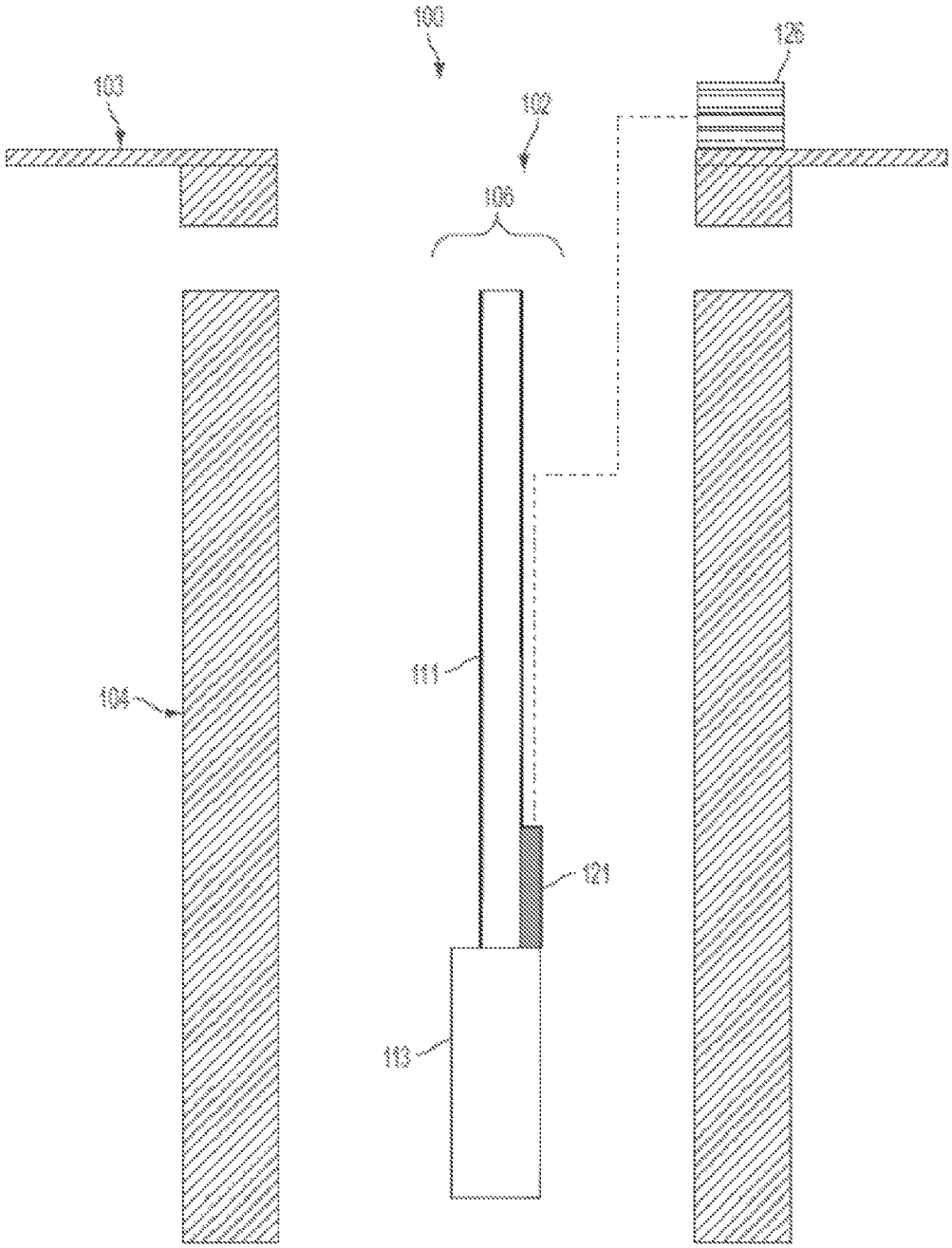
FIG. 1-1 is a schematic diagram of a well system tool string deployed in a wellbore, having a magnetostrictive transducer system, according to some aspects of the present disclosure.

Certain aspects of the present disclosure relate to an apparatus, system, and method for transmitting signals along a region of a tool string, deployed in a wellbore environment, where the structure of the tool string precludes the use of a mechanical or electrical connection to transmit signals. The need for such wireless signal transmission can arise where data is measured and collected at or proximate to a drill bit, where the collected data needs to be transferred uphole for further processing, but where other apparatus along the length of the tool string, such as a mud motor or other wire-blocking tool elements, render the use of wireline or slickline communication elements challenging or unfeasible.

Where a region of the tool string precludes the use of wireline or slickline communication elements, a magnetostrictive transducer can be used to convey received signals as acoustic waves into the metal of the tool string, particularly that interrupting region of the tool string. The acoustic signals can be received with an acoustic telemetry receiver, such as an accelerometer, located on an opposing side of the interrupting region across from the magnetostrictive transducer. The acoustic telemetry receiver can convert the acoustic waves to an electric signal for further transmission. The magnetostrictive transducer can be located on or adjacent to a drill collar of the tool string, and can transmit an acoustic signal with sufficient strength or gain to retain the substantive data of the signal to a receiver transducer up to about fifty feet (50') distant along the tool string. In drilling applications, however, the vibration of the drill head or drill bit can degrade or interfere with the acoustic signal transmitted along the tool string (alternatively referred to as a drill string for drilling applications).

A magnetostrictive transducer can be constructed from an electromagnet, where the magnetic core is made from an alloy exhibiting magnetostrictive properties, such as Terfenol-D. The magnetic core can be shaped as needed, such as into a generally cylindrical or rod-like shape, and can be referred to as a magnetostrictive core. Passing an electrical current through a coil or solenoid surrounding the magnetostrictive core causes the magnetostrictive core to stretch in length, where the change in dimension (or "strain") of the magnetostrictive core is generally proportional to the magneto-motive force of the electrical current. The strain of a magnetostrictive element can be understood as the extension or change in length produced by a magnetically induced stress, caused by the magnetic domains lining up their long axes in response to the applied coercive magnetic force. The degree to which the magnetostrictive core can extend will relate to the tensile modulus (Young's modulus) of the material from the magnetostrictive core is constructed. Each magnetostrictive core can have a transfer characteristic, where the extension has a linear region where the strain is proportional to the magneto-motive force, and a saturation region, past the linear region, where the extension is less than proportional to the magneto-motive force. The power delivered by the current, the range of the linear strain region, and the range of the saturation stain region of the magnetostrictive core generally determines the degree of physical extension of the magnetostrictive core. The direction or polarity of the current can affect whether the strain of a magnetostrictive core leads to expansion or contraction, if the magnetostrictive core is already in a strained condition.

The basic signal for an acoustic link is a sine wave. Unmodulated, a sine wave has relatively small bandwidth due to the fact that the majority of the signal power is concentrated at the fundamental frequency, with some energy of the sine wave at higher order harmonic frequencies. A receiver for an unmodulated sine wave signal will be sensitive to a small range of frequencies either side of the sine wave frequency, with a bandwidth wide enough for the signal to be correctly interpreted. Without modification as disclosed herein, an alternating current applied to a solenoid containing a magnetostrictive core will produce a mechanical oscillation, and corresponding acoustic waves, at twice the electrical current frequency. The mechanical oscillation of the magnetostrictive core and the acoustic waves will have characteristics corresponding to the two peaks of amplitude, independent of polarity, over each single period of the electrical current signal. Thus, when the solenoid is driven with a sine wave, the mechanical output of the unmodified magnetostrictive core is analogous to a full-wave rectification of the input sine wave.

In some aspects of the present disclosure, to avoid a full-wave rectification effect, a preload force can be applied such that the magnetostrictive core is placed under stress to extend to a length approximately halfway through the linear region of the transfer characteristic. To establish the preload force, the magnetostrictive core is first magnetized to the maximum length through the saturation region so that the magnetostrictive core extends to its maximum length. A compressive load, the preload force, is then applied to compress the magnetostrictive core to a length at about half of the length of the maximum linear region extension. The extension of the magnetized magnetostrictive core, when subject to either or both of a physical preload component and a magnetic preload component, such that the magnetostrictive core is compressed to an operating length can be described as an equilibrium working point. The physical component of the preload force can include a spring positioned between the magnetostrictive core and the structure in which the magnetostrictive core is mounted. The opposing magnetic field component of the preload force can be derived from a permanent magnet located in a position to extend a magnetic force in a direction opposite to the field generated by the magnetized magnetostrictive core. The magnetic field established between the electrified solenoid and magnetostrictive core and the opposing magnetic field from the permanent magnet can be referred to as a permanent operating magnetic field. At any equilibrium working point, the magnetic field produced by the solenoid can increase or decrease based upon the input current and signal, and will thereby add or subtract to the permanent operating magnetic field, leading to a change or oscillation of the magnetostrictive core length about the equilibrium working point.

With the preload positioning of the magnetostrictive core at an equilibrium working point, the magnetostrictive transducer is capable of accounting for drilling or system vibration, the only signal measured is from a substantive carrier signal received from a sensor. The magnetized magnetostrictive core system thereby isolates, in a feedback loop, substantive signal in the drill collar from drilling vibration noise.

In other aspects of the present disclosure, the full-wave rectification effect of a magnetostrictive transducer can be incorporated into the signal transmission process, where the doubling of the received carrier signal due to the full-wave rectification effect provides for amplification of the signal through the magnetostrictive transducer. A compressive load, the preload force is applied to a non-magnetized magnetostrictive core such that the magnetostrictive core is compressed to a minimum length, where the strain of the magnetostrictive core is zero. The minimum length of the magnetostrictive core can be the operational length of the non-magnetized magnetostrictive core, and can be described as a baseline working point. The physical component of the preload force can include a spring positioned between the magnetostrictive core and the structure in which the magnetostrictive core is mounted. The opposing magnetic field component of the preload force can be derived from a permanent magnet located in a position to extend a magnetic force in a direction opposite to the direction in which magnetostrictive core extends. At the baseline working point, electrical current that is passed through the solenoid, regardless of polarity, causes the magnetostrictive core to extend, and will thereby leading an oscillation of the magnetostrictive core length at and above the baseline working point.

When a magnetostrictive transducer is deployed downhole in a wellbore, the preload force provided by the spring can vary due to loading on the collar, temperature changes in the wellbore environment, and vibration of the drill string to which the magnetostrictive transducer is attached. Such variation can lead to distortion products that affect signal driven into the magnetostrictive transducer, potentially compressing the magnetostrictive core of the magnetostrictive transducer to a minimum length (alternatively referred to as a zero point or baseline length), or extending the magnetostrictive core of the magnetostrictive transducer past the linear region and into the saturation region of the magnetostrictive core transfer characteristic. In both cases, the distortion products can lead to signals that are even order harmonics of a received carrier signal, particularly the production of second order harmonics. The harmonic distortion products can result in wasted transmission power and a reduced or diminished signal-to-noise ratio at a receiver.

In aspects of the present disclosure, an oscillator is used to select and provide a harmonic reference signal based on the substantive carrier signal. For a magnetostrictive transducer system having a magnetized magnetostrictive core, the oscillator can provide a second order harmonic signal as the reference signal. For a magnetostrictive transducer system having a non-magnetized magnetostrictive core, the oscillator can provide a sub-harmonic signal as the reference signal. The harmonic reference signal is driven to a phase detector, thus rendering the phase detector sensitive to only the oscillator frequency, which can be a relatively narrow frequency band. With the phase detector in combination with an integrator or signal filter, a detector module outputs a DC signal that is proportional to the reference harmonic. The DC signal can be referred to as a corrective signal, where the corrective signal is added or subtracted to the substantive carrier signal received and delivered to magnetostrictive transducer. The contribution of the corrective signal to the carrier signal causes the magnetostrictive core to extend or contract, thereby maintaining a working length and working point of magnetostrictive core, in order to remain at the position set by a preload force. In aspects, the oscillator can change the frequency of the reference signal it delivers during the course of operation, in response to changes in the substantive carrier signals received from a sensor.

The methods and systems of the present disclosure may be well suited to wireline or slickline sampling operations, permanent or semi-permanent production monitoring, logging while drilling (LWD) applications, or measurement while drilling (MWD) applications.

The illustrative examples discussed herein are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "uphole," "upward," "above," "downhole," "downward," "below," "inward," "outward," etc. in relation to the illustrative aspects as they are depicted in the figures, the uphole direction being toward the surface of the well, the downhole direction being toward the toe of the well, the inward direction being toward the longitudinal axis (which can also be referred to as the "primary axis" or "centerline") of the tool string, casing, or mandrel, and the outward direction being away from the longitudinal axis of the tool string, casing, or mandrel. Further, portions of structural elements described herein can be referred to by their general orientation when deployed, e.g. an uphole end or downhole end. Similarly, portions of structural elements described herein can be referred to by their interior (inward facing) and exterior (outward facing) surfaces. Like the illustrative aspects, the numerals and directional descriptions included in the following sections should not be used to limit the present disclosure.

FIG. 1-1 is a schematic diagram of a well system 100 having tool string 106 deployed in a wellbore 102 having a downhole tool 113 deployed within the wellbore 102, connected to a tubular member 111. A magnetostrictive transducer system 121 as disclosed herein can be mechanically coupled to both the downhole tool 113 and the tubular member 111. The downhole tool 113 can include one or more of tools used in wellbore 102 applications, including, but not limited to, drilling tools, production tools, completion tools, wireline and/or slickline communication tools. The magnetostrictive transducer system 121 can acoustically convey signals received via the downhole tool 113 along the tubular member 111, and further convey signals to a control unit 126 located at the surface 103 of the wellbore 102. In such aspects, the magnetostrictive transducer system 121 provides for a communication channel between different uphole and downhole regions of the tool string 106 and/or the control unit 126 by taking advantage of the mechanical connection provided by the tubular member 111. The control unit 126 can be in electrical communication with the magnetostrictive transducer system 121 and can include a non-transitory computer-readable medium and microprocessors configured in part to receive data from the magnetostrictive transducer system 121 located along the tool string 106. In some aspects, the magnetostrictive transducer system 121 can be an automatically adjusting system having a feedback functionality to, at least in part, amplify substantive signal and reduce noise from the received signal. Methods associated with the well drilling system 100 can incorporate principles of the present disclosure.

Figures 1, 2:
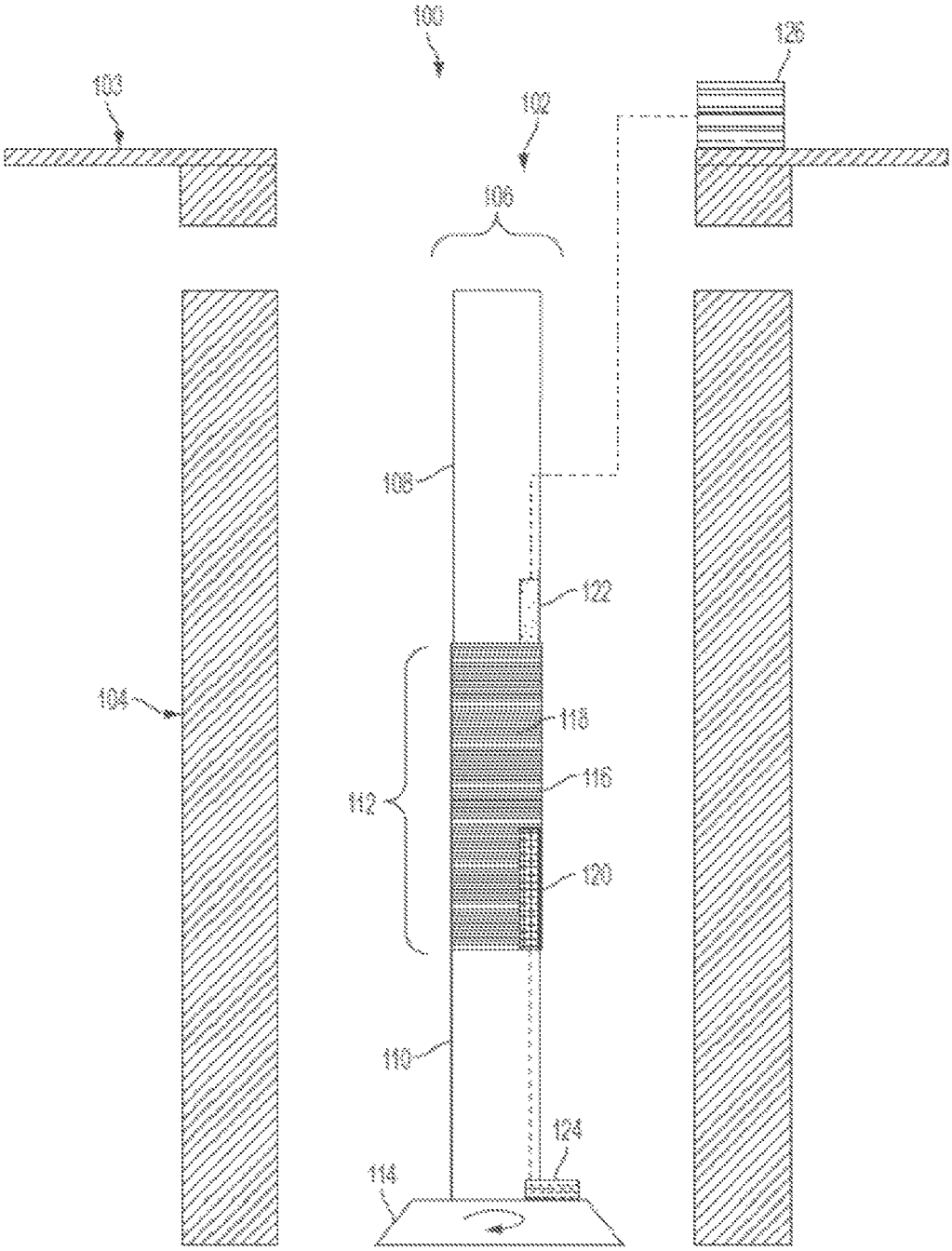
Figure 2:
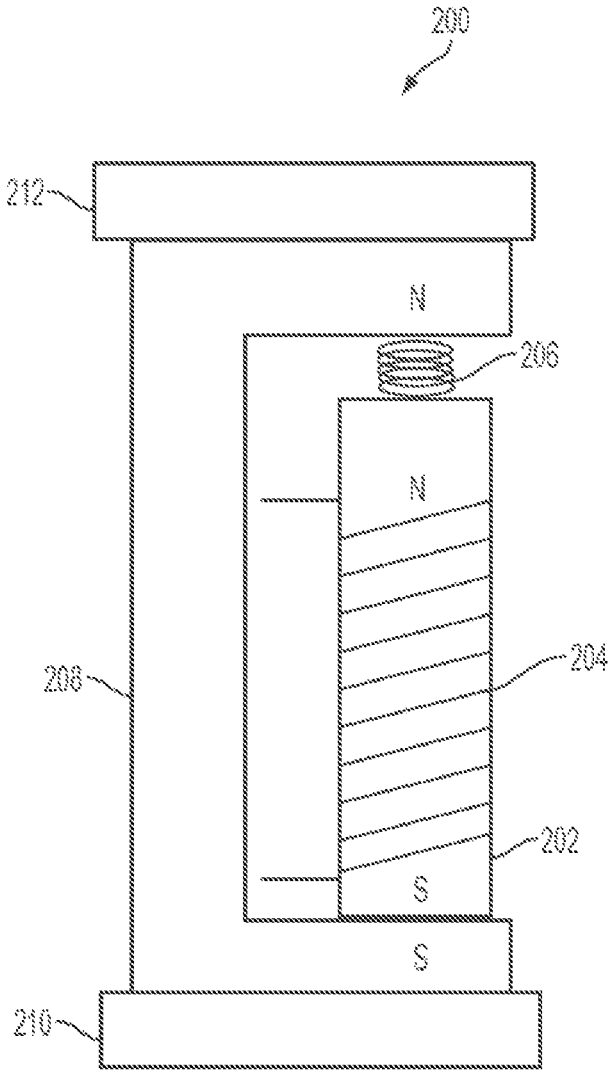

FIG. 1-2 is a schematic diagram of an alternative configuration of the well system 100 having tool string 106 deployed in a wellbore 102 having a magnetostrictive transducer 120 and an acoustic telemetry receiver 122. In the well drilling system 100 illustrated, a wellbore 102 formed in earth strata 104 is drilled by rotating a drill head 114 on an end of a tool string 106. In some aspects, the wellbore 102 can have a parent casing (not shown) present along the sides of the wellbore 102. Further, where the tool string 106 has a drilling apparatus as illustrated, the tool string 106 can alternatively be referred to as a drill sting. The drill head 114 can be a drill bit or other such wellbore drilling assembly as known in the industry. In alternative aspects, where the tool string 106 has a downhole production tool or completion tool, the tool string 106 can be referred to as a production string or a completion string.

In some aspects, the tool string 106 can include a first tool string region 108, a second tool string region 110, and a motor region 112, where the motor region 112 is mechanically coupled to the both of the first tool string region 108 and the second tool string region 110. As represented in FIG. 1-2, the first tool string region 108 is positioned uphole of the motor region 112, where the first tool string region 108 can include a plurality of sections, sensors, tools, communication apparatus, instrumentation, and other tool string apparatus used in well drilling systems in, on, or along the first tool string region 108 up to and through the well surface 103. The second tool string region 110 is positioned downhole of the motor region 112, where the second tool string region 110 can similarly include a plurality of sections, sensors, tools, communication apparatus, instrumentation, and other tool string apparatus used in well drilling systems in, on, or along the second tool string region 110 down to and until the bottom (or toe) of the wellbore 102, or end of the tool string 106. In other aspects, the tool string 106 can have one or more motor regions 112 located downhole, with further tool string regions in addition to the first tool string region 108 and second tool string region 110 located either or both of uphole or downhole of the one or more motor regions 112.

The motor region 112 can include a drill collar 116, which can be a structure that encloses or mounts a specific motor apparatus 118. The drill collar 116 can specifically couple to either or both of the first tool string region 108 and the second tool string region 110. The motor apparatus 118 can be a mud motor or other such device with moving parts or wire-blocking tool elements that preclude the use or passage of physical wires through the motor region 112. Structural aspects of the motor region 112 that preclude the use or passage of physical wires through the motor region 112 can include rotation of the motor apparatus 118, venting or exhaust fluids of the motor apparatus 118, or other mechanical strain exerted by elements of the motor region 112 that would interact with wireline or slickline communication elements if passed through or alongside the motor region 112.

The magnetostrictive transducer 120 can be arranged longitudinally along the tool string 106, parallel to the centerline of the tool string 106. In many aspects, the magnetostrictive transducer 120 is in a position below the motor region 112 and mechanically coupled to the drill collar 116. In other aspects, the magnetostrictive transducer 120 is at least in part mechanically coupled to the motor region 112. The magnetostrictive transducer 120 can further be in electrical communication with a downhole sensor 124, and receive signals from the downhole sensor 124 to transmit across the motor region 112. In some aspects, the downhole sensor 124 can be a drill head sensor, configured to measure and detect the functioning of the drill head 114, measuring parameters such as the rotation speed, changes in speed, pulses, or interruptions in the rotation of the drill head 114; i.e. MWD or LWD measurements. In other aspects, the downhole sensor 124 can measure and detect other parameters corresponding to the functioning of the tool string 106. In alternative aspects, the downhole sensor be a density sensor configured to detect characteristics of proximate formations in the earth strata 104. In further aspects, the downhole sensor 124 can be a battery powered sensor. The downhole sensor 124 can send signals uphole, where, for example, a positive signal can be sent at a first frequency (e.g., 1000 Hz) and a negative signal can be sent at a second frequency different from the first frequency (e.g., 900 Hz). In some aspects, the downhole sensor 124 sends substantive carrier signals uphole to the magnetostrictive transducer 120 through a wireline or slickline connection. The magnetostrictive transducer 120 converts the signals received from the downhole sensor 124 to an acoustic wave transmitted through the drill collar 116 and received by the acoustic telemetry receiver 122. In some aspects, the acoustic telemetry receiver 122 can be an accelerometer. The acoustic telemetry receiver 122 can be in electrical communication with a control unit 126 located at the surface 103 of the wellbore 102. The control unit 126 can include a non-transitory computer-readable medium and microprocessors configured in part to receive data from the acoustic telemetry receiver 122 located along the tool string 106. In some aspects, the control unit 126 can further control the operation of the tool string 106 and the drill head 114, or any other apparatus, tool, or instrumentation coupled to the tool string 106. The control unit 126 can further include a user interface to allow for an operator to monitor the function of the tool string 106 and any measurements of signals received from the acoustic telemetry receiver 122 or other sensory apparatus located downhole. In other aspects, the control unit 126 can include computer-executable instructions or algorithms to process, convert, transform, or otherwise manipulate data received from the acoustic telemetry receiver 122 or other sensory apparatus located downhole. The data from the acoustic telemetry receiver 122 located along the tool string 106 can be used in combination to with other sensory data or operating parameters to control the rate of drilling by the drill head 114 on the tool string 106. The control unit 126 can further be electronically coupled to other, local or remote, non-transitory computer-readable mediums (not shown) to transmit or receive data or operational instructions. In further aspects, the control unit can be coupled to a mobile transport (e.g., a truck) or stationary structure (e.g., an installation on an oil well tower) located at the surface 103.

FIG. 2 is a schematic illustration of a magnetostrictive transducer 200. The magnetostrictive core 202 is made from an alloy having magnetostrictive properties, and as shown in FIG. 2 can be shaped as a rod having a longitudinal (primary) axis. The magnetostrictive transducer 200 can similarly be defined to have a longitudinal axis, which can be coupled in alignment with the longitudinal axis of a downhole tubular, e.g., a drilling string, a production string, a casing string, or other tubular member. A coil 204 (alternatively referred to as a solenoid) made of a conductive metal is wrapped around the magnetostrictive core 202, and passing a current through the coil 204 causes the magnetostrictive core 202 to extend in length. The magnetostrictive core 202 and coil 204 herein are mounted within a permanent magnet frame 208 with a preload spring 206 positioned in between opposing surfaces of the magnetostrictive core 202 and the permanent magnet frame 208. The magnetostrictive core 202 and permanent magnet frame 208 are oriented relative to each other such that each positive pole and each negative pole are directly in opposition to each other. Either or both of the permanent magnet frame 208 and preload spring 206 can apply a preload force that compresses the magnetostrictive core 202, where the preload force is opposite in direction to the strain extension of the magnetostrictive core 202 when a current is passed through the coil 204. In other words, the direction of the magnetic flux from the permanent magnet frame 208 and the physical force of the preload spring 206 can be parallel to each other.

In some aspects, the magnetostrictive core 202 can be magnetized such that the magnetostrictive core 202 extends to a maximum potential length before the application of any preload force. In such aspects, the combination of the preload force from the preload spring 206 and permanent magnet frame 208 compresses the magnetized and extended magnetostrictive core 202, resulting in the magnetostrictive core 202 extended to an equilibrium length that is about half the total potential length that the magnetostrictive core 202 can extend. This half-point equilibrium length can be referred to as the working point of a magnetized magnetostrictive transducer 200. Further extension or compression of the magnetostrictive core 202 due to current passed through the coil 204 can be centered about the half-point equilibrium length, where the polarity of the current passed through the coil 204 determines whether the magnetostrictive core 202 stretches or compresses from the half-point equilibrium length. The power of the current passed through the coil 204 determines to what degree the magnetostrictive core 202 stretches or compresses from the half-point equilibrium length.

In other aspects, the magnetostrictive core 202 can be non-magnetized such that the magnetostrictive core 202 is at a baseline length before the application of any preload force. In such aspects, the combination of the preload force from the preload spring 206 and permanent magnet frame 208 compresses the magnetized and extended magnetostrictive core 202, resulting in the magnetostrictive core 202 compressed to an equilibrium length that is about the minimum potential length that the magnetostrictive core 202 can compress. This minimum or baseline equilibrium length can be referred to as the working point of a non-magnetized magnetostrictive transducer 200. Further extension of the magnetostrictive core 202 due to current passed through the coil 204 can be based on the minimum equilibrium length, where the power of the current passed through the coil 204, regardless of polarity, determines what degree the magnetostrictive core 202 stretches from the minimum equilibrium length.

The permanent magnet frame 208 is further mechanically coupled to a first drill collar region 210 and a second drill collar region 212. In alternative aspects, the first drill collar region 210 and the second drill collar region 212 can be parts of the same drill collar on a drill string, or parts of separate drill collars on a tool string. When a current is passed through the coil 204 causing the magnetostrictive core 202 to extend, the magnetostrictive core 202 exerts a longitudinal pressure on the permanent magnet frame 208 thereby generating an acoustic wave. Either or both of the first drill collar region 210 and the second drill collar region 212 can receive acoustic waves from the permanent magnet frame 208, which can thereby travel through a drill collar to an acoustic telemetry receiver elsewhere on the drill string.

Figure 3:
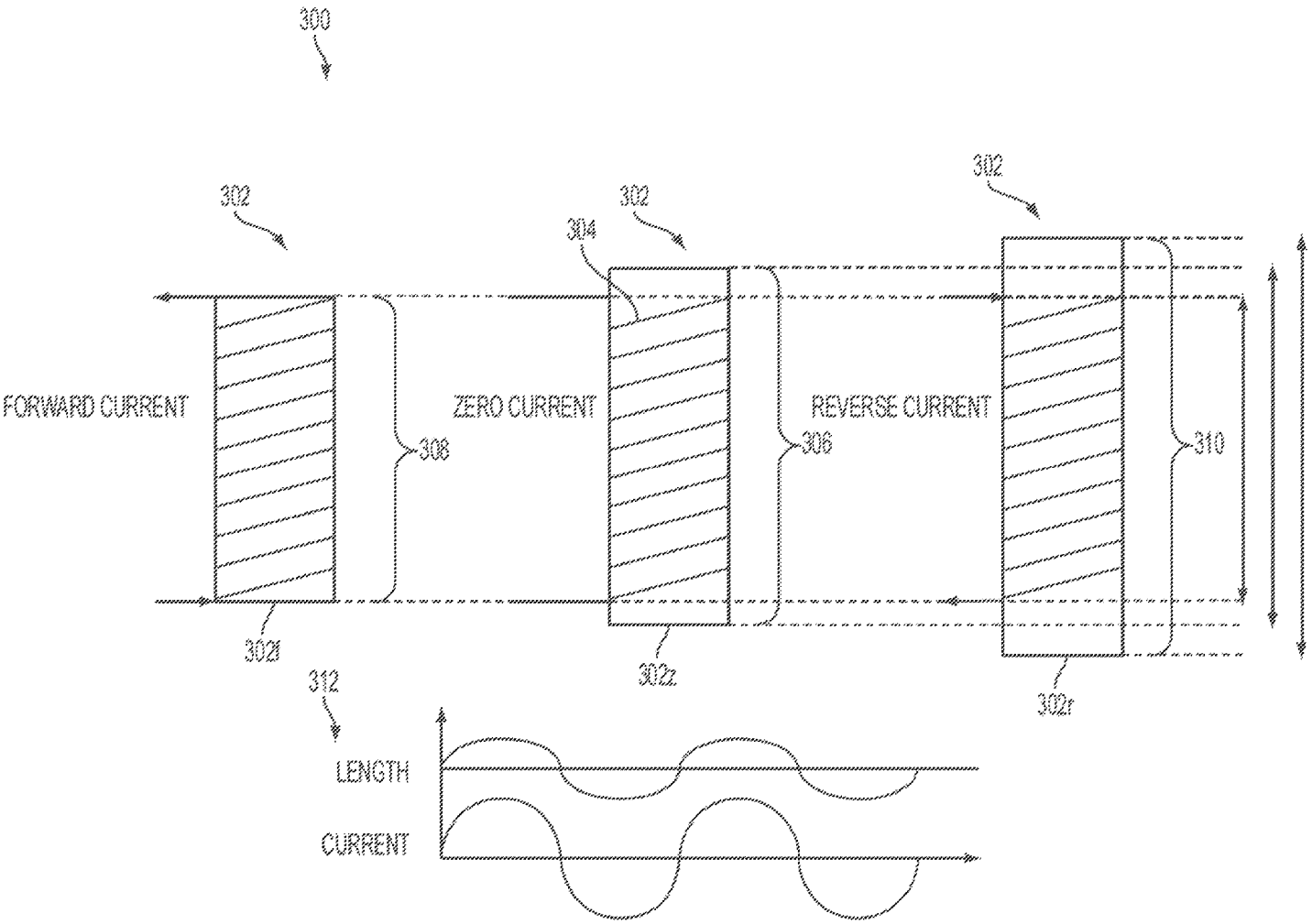
FIG. 3 is a schematic diagram of the response of a magnetostrictive core to an input current in a coil, where the magnetostrictive core is magnetized and is subject to a preload force, according to some aspects of the present disclosure.

FIG. 3 is a schematic diagram of the response 300 of a magnetostrictive core 302 to an input current in a coil 304, where the magnetostrictive core 302 is magnetized and is subject to a preload force. The schematic diagram of the response 300 illustrates the magnetostrictive core 302 and coil 304 in isolation to show the response of a magnetized magnetostrictive core 302 when current is passed through the coil 304, though a preload force is acting on the magnetostrictive core 302 through a spring and permanent magnet (not shown). The magnetostrictive core 302 is shown in three states: the magnetostrictive core subject to zero current 302*z* through the coil 304, the magnetostrictive core subject to forward current 302*f* through the coil 304, and the magnetostrictive core subject to reverse current 302*r* through the coil 304. The magnetostrictive core subject to zero current 302*z* through the coil 304 has a zero-current length 306, which is the length of the magnetostrictive core 302 magnetized to extend to the strain saturation point of the magnetostrictive core 302 and compressed by a preload force. The zero-current length 306 can be about half of the extension range of the magnetostrictive core 302 between a fully compressed length of the magnetostrictive core 302 and the maximum linear region extension of the magnetostrictive core 302. At the zero-current length 306, the magnetostrictive core subject to zero current 302*z* has the greatest potential range of motion in response to positive or negative sinusoidal signals received through the coil 304. The magnetostrictive core subject to forward current 302*f* through the coil 304 has a forward-current length 308, which is the maximum linear region extension of the magnetostrictive core 302 (not extending into the strain saturation region of the magnetostrictive core 302), compressed by a preload force, and then subject to a current through the coil 304 that has a magnetic flux in the same direction as the preload force. The forward-current length 308 can be the length of magnetostrictive core 302 compressed to about a minimum length. At the forward-current length 308, the magnetostrictive core subject to forward current 302*f* has the greatest potential range of motion in response to positive sinusoidal signals received through the coil 304. In some aspects, the forward-current length 308 can be equivalent to the length of a non-magnetized magnetostrictive core. The magnetostrictive core subject to reverse current 302*r* through the coil 304 has a reverse-current length 310, which is the length of the magnetostrictive core 302 magnetized to extend to maximum linear region extension of the magnetostrictive core 302, compressed by a preload force, and then subject to a current through the coil 304 that has a magnetic flux in the direction opposite to the preload force. The reverse-current length 310 can be the length of magnetostrictive core 302 extended to a maximum length within the linear range of extension of the magnetostrictive core 302, before extending into a strain saturation regime. At the reverse-current length 310, the magnetostrictive core subject to reverse current 302*r* has the greatest potential range of motion in response to negative sinusoidal signals received through the coil 304.

Plot 312 illustrates the change in length of a magnetostrictive core 302, magnetized and subject to a preload force, in response to the current passing through a coil 304 wrapped around the magnetostrictive core 302. Plot 312 shows that for a magnetostrictive core 302 that is magnetized and subject to a preload force, an input current can cause the magnetostrictive core 302 to expand and contract proportionally to the input current. In particular, over the course of a period or cycle of current, starting with a zero current value, the magnetostrictive core subject to zero current 302*z* has a zero-current length 306, becomes subject to a reverse current 302*r* passed through the coil 304 to expand to a reverse-current length 310, returns to being subject to zero current 302*z* and correspondingly returning to the zero-current length 306, becoming subject to a forward current 302*f* and contracting to a forward-current length 308, and cycling back to be subject to zero current 302*z* and correspondingly returning to the zero-current length 306.

Figure 4:
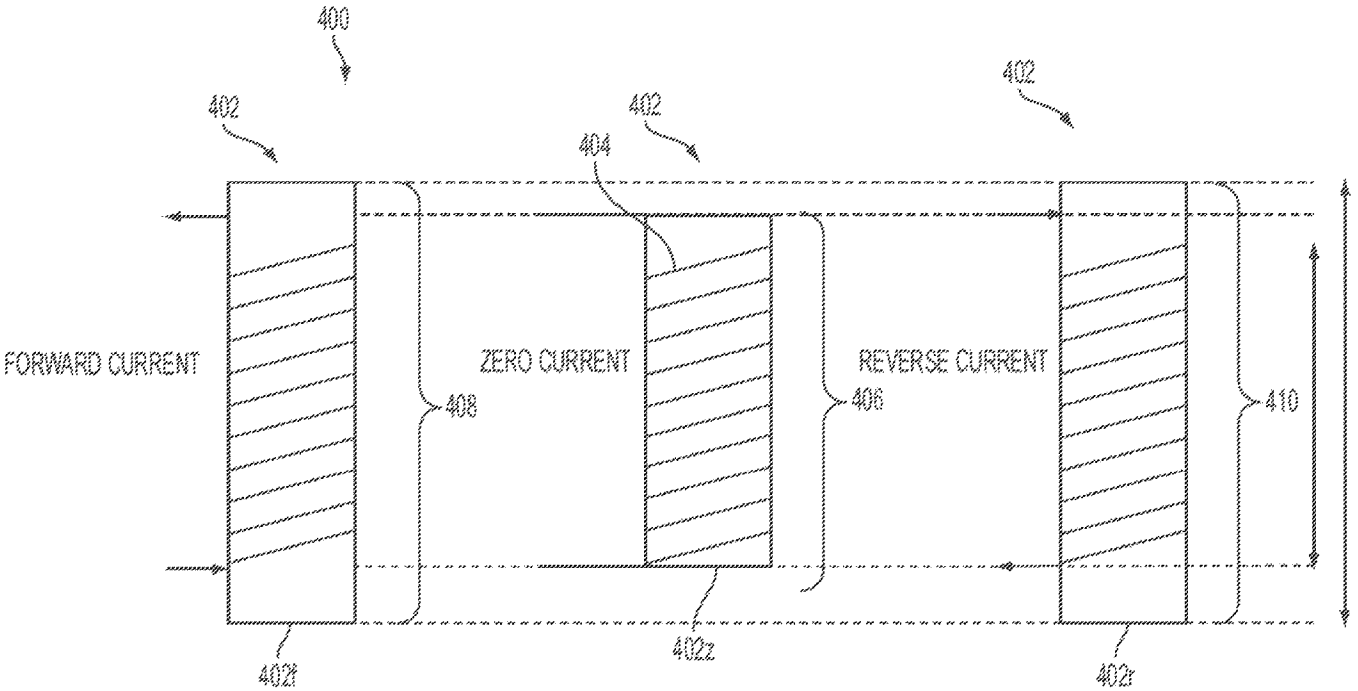
FIG. 4 is a schematic diagram of the response of a magnetostrictive core to an input current in a coil, where the magnetostrictive core is non-magnetized and is subject to a preload force, according to some aspects of the present disclosure.
Figure 4:
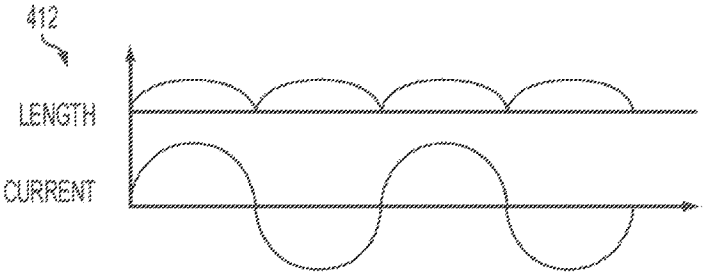

FIG. 4 is a schematic diagram of the response 400 of a magnetostrictive core 402 to an input current in a coil 404, where the magnetostrictive core 402 is non-magnetized and is subject to a preload force. The schematic diagram of the response 400 illustrates the magnetostrictive core 402 and coil 404 in isolation to show the response of a non-magnetized magnetostrictive core 402 when current is passed through the coil 404, though a preload force is acting on the magnetostrictive core 402 through a spring and permanent magnet (not shown). The magnetostrictive core 402 is shown in three states: the magnetostrictive core subject to zero current 402*z* through the coil 404, the magnetostrictive core subject to forward current 402*f* through the coil 404, and the magnetostrictive core subject to reverse current 402*r* through the coil 404. The magnetostrictive core subject to zero current 402*z* through the coil 404 has a zero-current length 406, which can be the baseline length of the magnetostrictive core 402 when not magnetized and compressed by a preload force. The zero-current length 406 can be the minimum length of the magnetostrictive core 402. At the zero-current length 406, the magnetostrictive core subject to zero current 402*z* responds to both positive and negative sinusoidal signals received through the coil 404 by expanding, regardless of the polarity of the current. The magnetostrictive core subject to forward current 402*f* through the coil 404 has a forward-current length 408, which is the magnetostrictive core 402 (not extending into the strain saturation region of the magnetostrictive core 402), compressed by a preload force, and then subject to a current through the coil 404 that has a magnetic flux in the same direction as the preload force. The forward-current length 408 can be the maximum linear region extension length of magnetostrictive core 402. The magnetostrictive core subject to reverse current 402*r* through the coil 404 has a reverse-current length 410, which is the magnetostrictive core 402 (not extending into the strain saturation region of the magnetostrictive core 402), compressed by a preload force, and then subject to a current through the coil 404 that has a magnetic flux in the opposite direction as the preload force. The reverse-current length 410 can be the maximum linear region extension length of magnetostrictive core 402. In some aspects, for a non-magnetized magnetostrictive core 402 the forward-current length 408 can be equivalent to the reverse-current length 410.

Plot 412 illustrates the change in length of a magnetostrictive core 402, non-magnetized and subject to a preload force, in response to the current passing through a coil 404 wrapped around the magnetostrictive core 402. Plot 412 shows that for a magnetostrictive core 402 that is non-magnetized and subject to a preload force, an input current can cause the magnetostrictive core 404 to expand proportionally to the input current. In particular, over the course of a period or cycle of current, starting with a zero current value, the magnetostrictive core subject to zero current 402*z* has a zero-current length 406, becomes subject to a reverse current 402*r* passed through the coil 404 to expand to a reverse-current length 410, returns to being subject to zero current 402*z* and correspondingly returning to the zero-current length 406, becoming subject to a forward current 402*f* and expanding to a forward-current length 408, and cycling back to be subject to zero current 402*z* and correspondingly returning to the zero-current length 406. Over the cycle of an input signal, where the amplitude of the input current is constant, the reverse-current length 410 and the forward-current length 408 can be equal.

Figure 5:
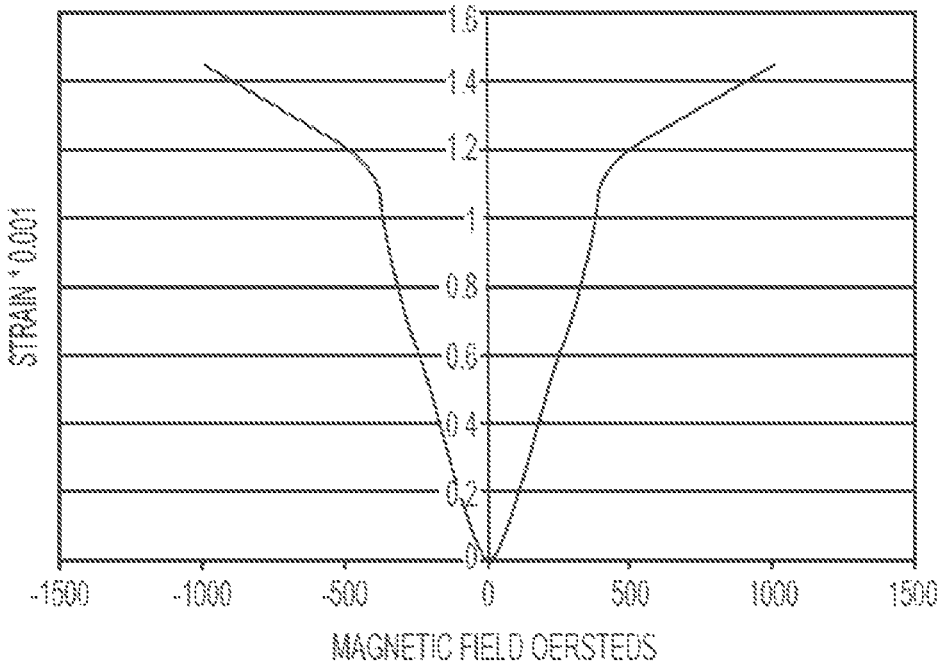
FIG. 5 is a graph of the transfer characteristic of strain response for a magnetostrictive core in response to a coercive force from a magnetic field, according to some aspects of the present disclosure.

FIG. 5 is a graph of an exemplary transfer character of strain response for a magnetostrictive core in response to a coercive force from a magnetic field. For a magnetostrictive transducer, as an input signal causes the magnetic field to increase or decrease in polarity or power, the magnetostrictive core will change in length proportionally to that magneto-motive force along the transfer characteristic. The transfer characteristic can have a linear region and a saturation region. For a magnetostrictive core having an exemplary transfer characteristic as in FIG. 5, the linear region of the transfer characteristic correlates to a magnetic field from zero to five hundred oersteds (0-500 Oe). At the maximum value of the linear region of the transfer characteristic, the length of the magnetostrictive core has a strain of about 0.12% when subjected to a magnetic field with a strength of about 500 Oe (either positive or negative in polarity). The saturation region of the transfer characteristic correlates to a magnetic field of greater than about 500 Oe (either positive or negative in polarity). While the magnetostrictive core will continue to change in length in response to increasing power of the magnetic field, the rate of change is less than within the linear region of the magnetostrictive core transfer characteristic. The transfer characteristic of any given magnetostrictive core can depend on the magnetostrictive alloy used to form the magnetic core, density of the magnetostrictive core, or other characteristics of the magnetostrictive core. The variation of transfer characteristics can provide for a magnetostrictive core having a linear region of from zero to about five hundred fifty oersteds (0-550 Oe), from zero to about six hundred oersteds (0-600 Oe), from zero to about seven hundred fifty oersteds (0-750 Oe), from zero to about one thousand oersteds (0-1000 Oe), or increments or gradients of magnetic field strength within those ranges.

Figure 6:
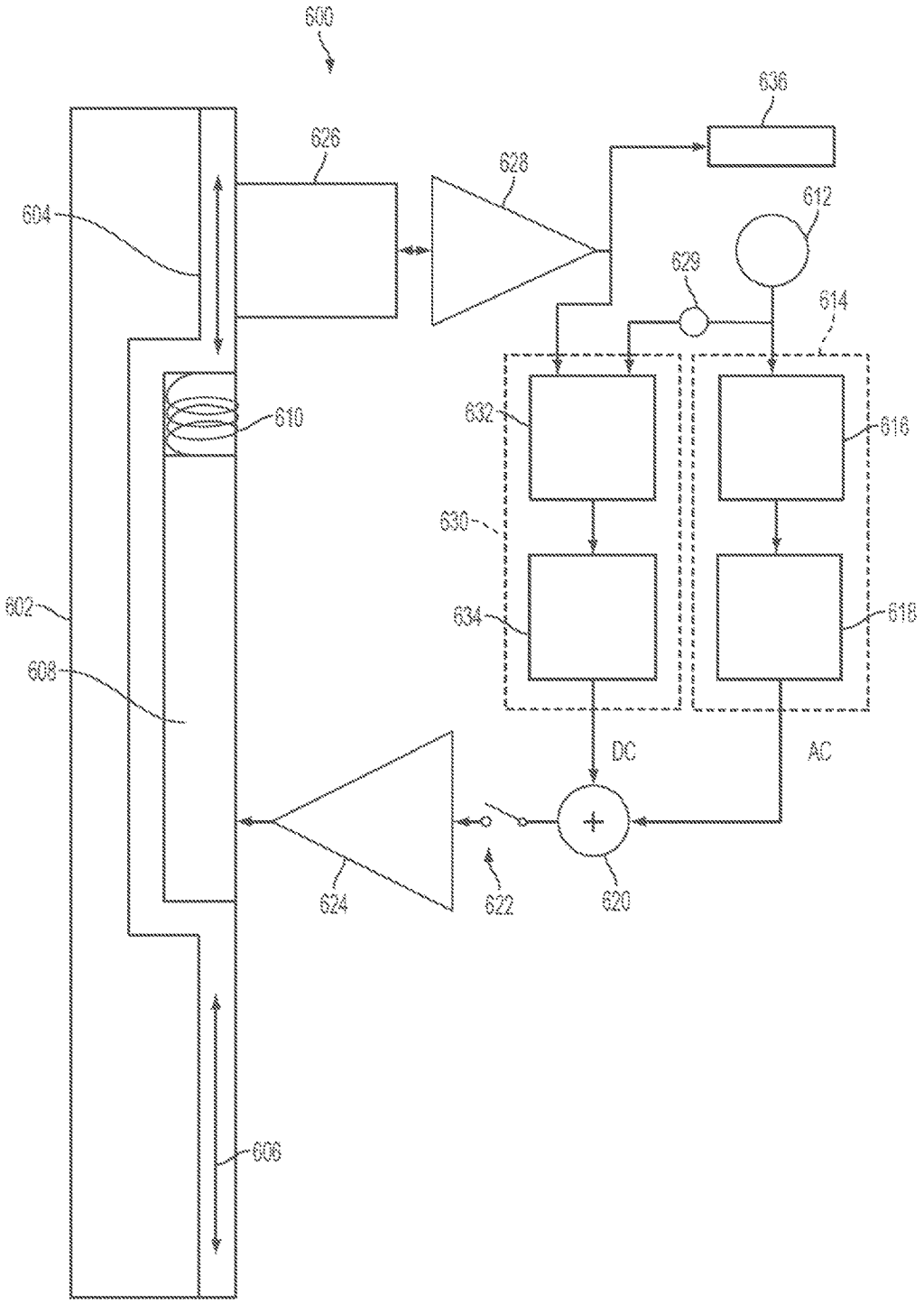
FIG. 6 is a schematic system diagram of a magnetostrictive transducer having a feedback control loop to automatically adjust the preload force in a magnetostrictive transducer, where the magnetostrictive core is magnetized, according to some aspects of the present disclosure.

FIG. 6 is a schematic system diagram 600 of a magnetostrictive transducer 608 having a feedback control loop to automatically adjust the preload force in the magnetostrictive transducer 608, where the magnetostrictive core of the transducer is magnetized. A magnetostrictive transducer 608 according to the present disclosure can be mounted on a tubular member of a tool string to provide for an acoustic communication channel along a length of the tubular member. In one exemplary application, the tool string to which the magnetostrictive transducer 608 is mounted can be a drill string, that in part includes a drill string motor. A drill string motor region 602 is a section of the overall drill string where functional components of the drill string motor region 602, such as the motor, preclude the use of signal communication by elements such as wireline or slickline connections. A drill collar 604 is mounted over the drill string motor region 602, or is constructed as part of the casing of the drill string motor region 602. The drill collar 604 is further constructed to have a pocket or a cavity that can encase, hold, or support the magnetostrictive transducer 608. The drill collar 604 cavity for the magnetostrictive transducer 608 can be oriented on either the exterior or interior side of the drill collar 604. A preload spring 610 is located within the drill collar cavity 604, exerting at least a part of a preload force on the magnetostrictive transducer 608. When the magnetostrictive transducer 608 extends in length, the magnetostrictive transducer 608 applies longitudinal pressure on the drill collar 604, resulting in acoustic waves 606 (alternatively referred to as longitudinal compression waves), that travel along the length of the drill collar 604.

The magnetostrictive transducer 608 converts electrical signals into acoustic signals, and receives electrical signals from both a filtered sensory signal input and a control loop feedback signal. Initially, a carrier signal (alternatively referred to as a sensory signal) is received by an oscillator 612 from a sensor, located elsewhere on the drill string. In various aspects, the oscillator 612 can provide a sine wave signal, a square wave signal, or a signal with another form, shape, or frequency, or a combination thereof. The oscillator 612 can double the frequency of the carrier signal received from the sensor. Thus, for example, a carrier signal frequency of 1000 Hz is doubled to 2000 Hz by the oscillator 612. The doubled carrier signal is thus a second order harmonic of the received carrier signal frequency. The oscillator 612 delivers the doubled carrier signal to both of a filter module 614 and a detector module 630. Generally, the signal produced by the oscillator 612 is referred to as a reference signal. In some aspects, the oscillator 612 can be used for bidirectional applications allowing the magnetostrictive transducer 608 system to both supply and receive signal.

In the filter module 614, the doubled carrier signal enters a division function 616, which can be set to be a divide-by-two function, the thereby returning doubled carrier signal back to the original carrier frequency. In other aspects, the oscillator 612 can increase a received carrier signal by a factor of one-and-a-half, three, four, or the like. In any such aspect, the division function 616 of the filter module 614 will convert the reference signal received from the oscillator 614 back to the same frequency of the carrier signal as received by the oscillator 612. In some aspects, the oscillator 612 can convert the carrier signal to have square waveform; the corresponding division function 616 can be a flip-flop circuit. The signal that is passed through the division function 616 within the filter module 614 is delivered to a low-pass filter 618. The low-pass filter 618 can receive any signal or waveform from the division function 616 and produce a sine wave output signal without introducing phase shifts. In some aspects, the low-pass filter 618 can be a Bessel filter. The sinusoidal signal output by the filter module 614 can be referred to as a filtered carrier signal. The filtered carrier signal is delivered to an additive function 620 where the filtered carrier signal is added to a corrective signal. The additive function 620 delivers the combined filtered carrier signal and corrective signal to a power amplifier 624 across a modulation switch 622. The modulation switch 622 can actuate between an open and closed position, allowing for continuous, pulsed, or intermittent delivery of signal to the power amplifier 624.

The power amplifier 624 produces an amplified carrier signal, the drive signal, which is delivered to and drives the magnetostrictive transducer 608. In some aspects, the power amplifier 624 can be a linear amplifier. The magnetostrictive transducer 608 includes a coil wrapped around a magnetized magnetostrictive core, where the amplified input signal enters the coil and thereby causes the magnetostrictive core, and thus the magnetostrictive transducer 608, to expand or contract. As the amplified input signal enters the coil, the magnetostrictive transducer 608 expands or contracts based on the working point length of the magnetostrictive transducer 608, and whether the polarity of the amplified input signal is in the same or opposite direction as a magnetic preload force acting on the magnetostrictive transducer 608. In aspects where the magnetostrictive transducer 608 expands and exerts pressure on the drill collar 604, acoustic waves 606 travel along the length of the drill collar 604 and are received by an acoustic telemetry receiver 626. In some aspects, the acoustic telemetry receiver 626 can be an accelerometer. The acoustic telemetry receiver 626 converts the signal based on the acoustic waves 606 by generating analogue electric signals. The electric signals produced by the acoustic telemetry receiver 626 are delivered to a charge amplifier 628. The charge amplifier 628 produces a corresponding output signal which is delivered to both the detector module 630 and a processing receiver 636. The combination of the acoustic telemetry receiver 626 and charge amplifier 628 can have a sufficient dynamic range to account for drilling vibration, ranges of motion for the internal components of the acoustic telemetry receiver 626 and charge amplifier 628 such that the combination does not provide output signal based on vibration alone. The output signal should correspond to the carrier signal initially received by the oscillator 612, and thereby provide data corresponding to the carrier signal from the sensor to the processing receiver 636.

The detector module 630 can include a phase detector 632 and an integrator 634, where the detector module 630 receives two signal inputs, the reference signal from the oscillator 612 and the output signal from the charge amplifier 628. In some applications, the detector module 630 can be referred to as a lock-in detector. The phase detector 632 receives both the reference signal from the oscillator 612 and the output signal from the charge amplifier 628 and can use those signals to determine and produce a voltage difference between the signals. In other words, the phase detector 632 can correlate the second order harmonic of the output signal with the reference signal from the oscillator 612. Where the reference signal is the doubled carrier signal from the oscillator 612, the reference signal represents the second order harmonic of the carrier signal. The output signal from the charge amplifier 628 will include some noise, much of which will be in the second order harmonic range based on the substantive carrier signal. The difference between the reference signal and output signal determined by the phase detector 632 thus represents system noise in the output signal stemming from sources such as vibration in the overall drill string. The signal produced by the phase detector 632 a series of pulses with a DC component, proportional to the level of second harmonic in the output signal and also proportional to the phase of the output signal. In some aspects, phase detector 632 can be an analogue multiplier or a multiplication operation within a digital signal processing ("DSP") chip.

The signal produced by the phase detector 632 is passed through an integrator 634, which can be a low-pass filter. The signal produced by the integrator 634 and the detector module 630 is a DC signal, referred to as the corrective signal, and sets the bandwidth of the feedback loop signal. The integrator 634 can be set to have a long time constant which can set the loop bandwidth, and which can be set to have a sufficiently narrow range to reject signal resulting from drilling or vibration noise. The corrective signal is provided to the additive function 620 and combined with the filtered carrier signal. Because the corrective signal component of the amplified input signal that drives the magnetostrictive transducer 608 is a DC signal, the resulting strain (expansion or contraction) of the magnetostrictive transducer 608 is maintained for as long as the corrective signal is provided. Moreover, the polarity of signal output by the integrator 634 has a direction or flux that can reduce, rather than increase, the production of second order harmonic distortion products. The resulting strain of the magnetostrictive transducer 608 thus alters the working length and equilibrium working point of the magnetostrictive transducer 608, moving the magnetostrictive transducer 608 equilibrium working point to a position and length where noise from the second order harmonic is minimized. Concurrently, the AC component of the amplified input signal from the filter module 614 continues to cause the magnetostrictive transducer 608 to strain about the adjusted equilibrium working point. In aspects, filtered carrier signal can be referred to as a first component of a drive signal and the corrective DC signal can be referred to as a second component of the drive signal.

Using a single phase detector 632 as illustrated, it is advisable to minimize any phase shifts of signal passing through the feedback control loop. To reduce potential phase shifts, the acoustic telemetry receiver 626 can be mounted adjacent to the magnetostrictive transducer 608 to minimize any mechanical phase shift. To further reduce potential phase shifts, the low-pass filter 618 can be a filter type having a constant group delay. In some aspects, acoustic telemetry receiver 626 can include a shift-sensing transducer, such as a piezoelectric transducer or a MEMS transducer. The shift-sensing transducer can examine the longitudinal pressure waves induced into the drill collar and shift the phase of the received wave to maintain an operational frequency for the feedback control loop. The shift-sensing transducer has sufficient bandwidth to pass the second order harmonic of the transmission frequency in the process of keeping phase shifts small. In other aspects, if phase delays cannot be sufficiently minimized, a phase shift 629 can be placed in between the oscillator 612 and detector module 630 to shift the reference frequency in order to compensate for the phase shift in the output signal. The phase shift 629 can be controlled and adjust the reference frequency with a DSP implementation of the feedback control loop.

The output signal from the charge amplifier 628 can be pulse modulated by opening and closing the modulation switch 622. Pulse modulation can allow the automatic feedback control loop to settle at an equilibrium working point, where once the loop reaches a steady-state, there be little if any change or disturbance in the working point between pulses because the second order harmonic will disappear in between pulses based on the actuation of the modulation switch 622.

At an ideal equilibrium working point, the signal produced by the phase detector 632 is zero, the integrator 634 output stabilizes, and the corrective signal from the detector module 630 also becomes zero, such that the amplified input signal has no DC component. The phase detector 632 will still produce a signal due to drilling and system noise, but the integrator 634 can filter signal received from the phase detector 632 to pass signal related to the second order harmonic frequency of the carrier signal. Thus at the ideal equilibrium working point, the DC corrective signal from the detector module 630 will go to zero because the difference in signal due to system and drilling noise will not have a correlation with the second order harmonic frequency of the carrier signal.

The processing receiver 636 can be a non-transitory computer-readable medium, having programming instructions to evaluate, process, relay, transmit, or otherwise modify or manipulate signal data received through a magnetostrictive transducer 608. The processing receiver 636 can be located downhole along a drill sting or at the surface of a well system coupled to the drill string. In some aspects, the processing receiver 636 can be further coupled to a control unit having an interface to allow for an operator to monitor received output signal and to alter operation of the drill string based upon the received output signal. In other aspects, the processing receiver 636 can be further coupled to a control unit having a set of automatic processing instructions to alter operation of the drill string based upon the received output signal.

Figures 1, 7:
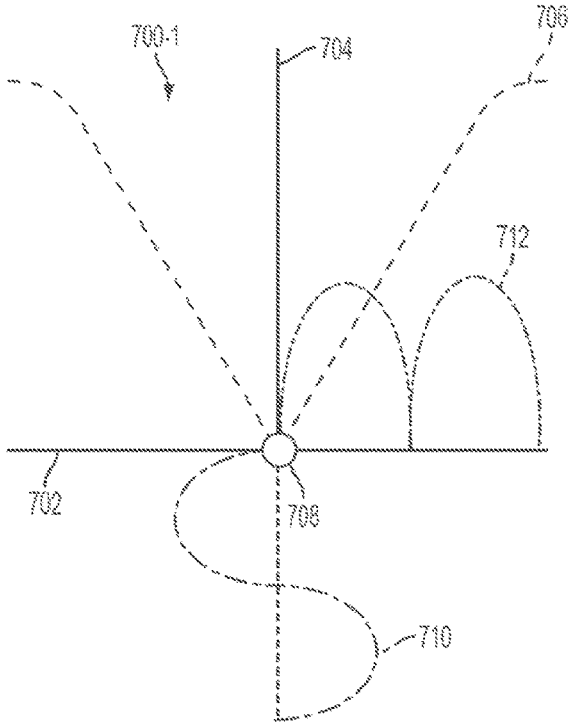
Figures 2, 7:
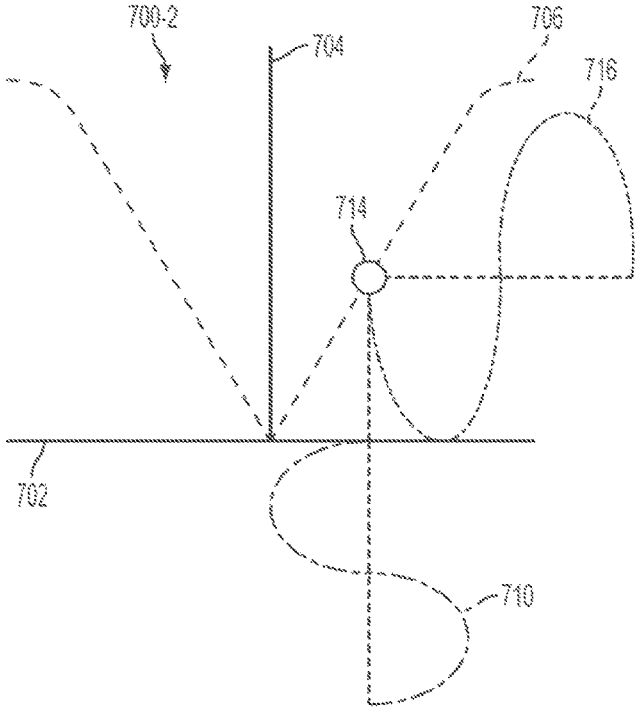
Figures 3, 7:
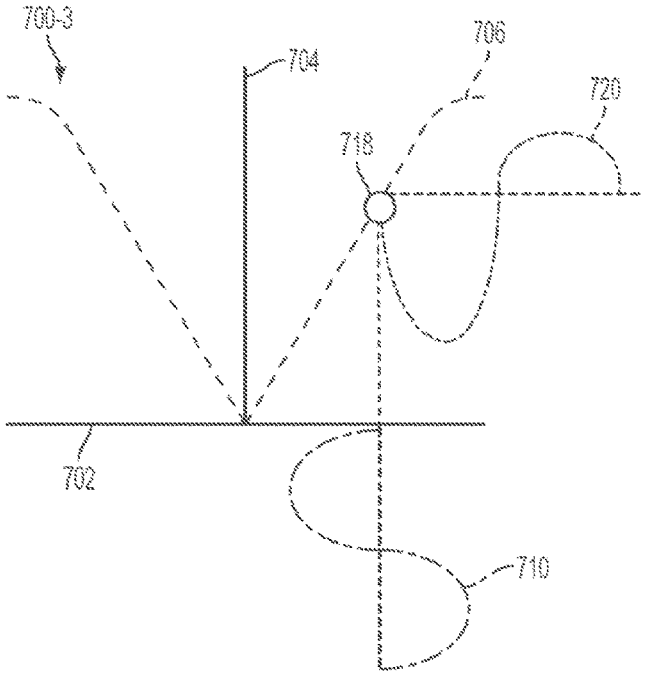
Figures 4, 7:
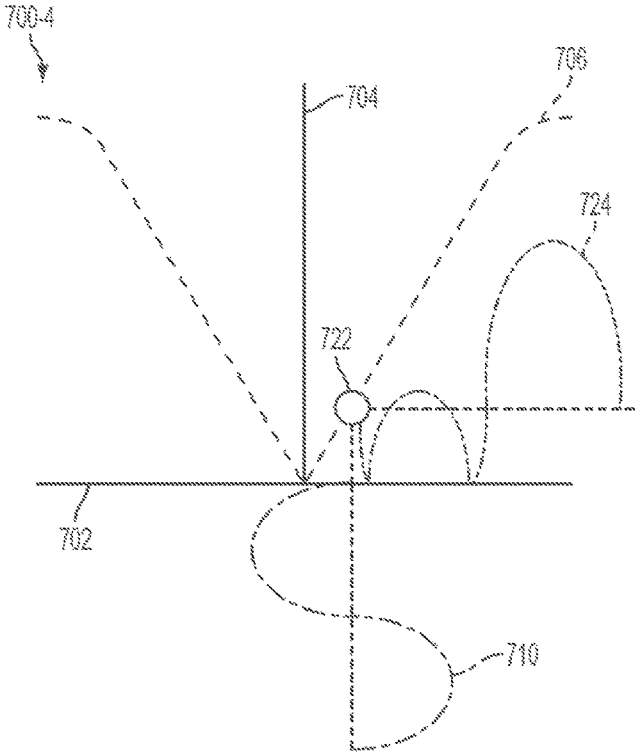

FIG. 7-1 is a graph 700-1 of the strain response 712 of a magnetostrictive core in response to a coercive force 702 from a magnetic field, where the magnetostrictive core is not yet magnetized, and with no preload force acting on the magnetostrictive core. The graph 700-1 plots the coercive force 702 of a magnetic field against the strain extension 704 of a magnetostrictive core, and further plots the transfer characteristic 706 of a magnetostrictive core under strain (as described in FIG. 5). The graph 700-1 shows that a magnetostrictive core with no preload force has a working point where there is no magnetic coercive force and the length of the magnetostrictive core has zero strain extension, referred to as a zero working point 708. Under conditions as illustrated in graph 700-1, with an input sinusoidal electrical drive signal 710 (delivered through a coil wrapped around the magnetostrictive core), the strain response 712 of the magnetostrictive core extends proportionally to the amplitude of the drive signal 710, regardless of the polarity of the drive signal 710. The strain response 712 is thereby analogous to a full-wave rectification of the drive signal 710. In other words, the mechanical frequency of the magnetostrictive core expansion and contraction becomes twice the frequency of the electrical drive signal 710. This output can be considered as a wholly second order harmonic distortion.

FIG. 7-2 is a graph 700-2 of the strain response 716 of a magnetized magnetostrictive core in response to a coercive force 702 from a magnetic field, with a preload force acting on the magnetostrictive core to set the magnetostrictive core at an equilibrium working point 714. The graph 700-2 shows that a magnetized magnetostrictive core subject to a preload force that includes a magnetic coercive force 702 component can have an equilibrium working point 714 set halfway in the linear range of the transfer characteristic 706. The preload force applied to the magnetostrictive core can have a physical component, such as from a spring, and a magnetic component, such as from a permanent magnet with a flux direction opposite to the direction in which the magnetostrictive core extends. With an equilibrium working point 714 set halfway in the linear range of the transfer characteristic 706, the mechanical oscillation output of the magnetostrictive core is a proportional reproduction of the electrical drive signal 710 that accurately reflects both the amplitude and polarity of the sinusoidal electrical drive signal 710.

FIG. 7-3 is a graph 700-3 of the strain response 720 of a magnetized magnetostrictive core in response to a coercive force 702 from a magnetic field, with insufficient preload force acting on the magnetostrictive core thereby setting the magnetostrictive core at a high-strain working point 718, above an equilibrium working point. Where the preload force is insufficient, due to either or both of too little spring pressure and too little magnetic flux in an opposing direction to the strain from a permanent magnet, the magnetostrictive core will settle at a high-strain working point 718, which is more than halfway up the transfer characteristic 706. At the high-strain working point 718, the mechanical oscillation of the magnetostrictive core in response to the electrical drive signal 710 will lead to the positive peaks of the strain response 720 being clipped, limited, or dampened due to the magnetostrictive core expanding into the saturation region of the transfer characteristic 706. The resulting asymmetric waveform is not an accurate reflection of the electrical drive signal 710 and includes a significant amount of second order harmonic distortion.

FIG. 7-4 is a graph 700-4 of the strain response 724 of a magnetized magnetostrictive core in response to a coercive force 702 from a magnetic field, with an excessive preload force acting on the magnetostrictive core thereby setting the magnetostrictive core at a low-strain working point 722, below an equilibrium working point. Where the preload force is excessive, due to either or both of too much spring pressure and too much magnetic flux in an opposing direction to the strain from a permanent magnet, the magnetostrictive core will settle at a low-strain working point 722, which is less than halfway up the transfer characteristic 706. At the low-strain working point 722, the mechanical oscillation of the magnetostrictive core in response to the electrical drive signal 710 will lead to the negative peaks of the strain response 720 being subject to phase reversal due to the magnetostrictive core being compressed to a minimum length, thus forcing the magnetostrictive core to in part expand upward along transfer characteristic 706 during the negative portion of the frequency cycle of the electrical drive signal 710. The resulting asymmetric waveform is not an accurate reflection of the electrical drive signal 710 and includes a significant amount of second order harmonic distortion.

As seen in FIGS. 7-1 through 7-4, operation of a magnetostrictive transducer with a magnetized magnetostrictive core at a working point other than an equilibrium working point 714 can lead to strain responses of the magnetostrictive core (and thus of the magnetostrictive transducer) that do not accurately reflect the amplitude, frequency, or phase of an input electrical drive signal 710. Automatic preload adjustment of a magnetized magnetostrictive transducer as shown in FIG. 6 maintains a magnetostrictive transducer system such that the working point of a strained core is at an equilibrium working point 714 as seen in FIG. 7-2.

Figure 8:
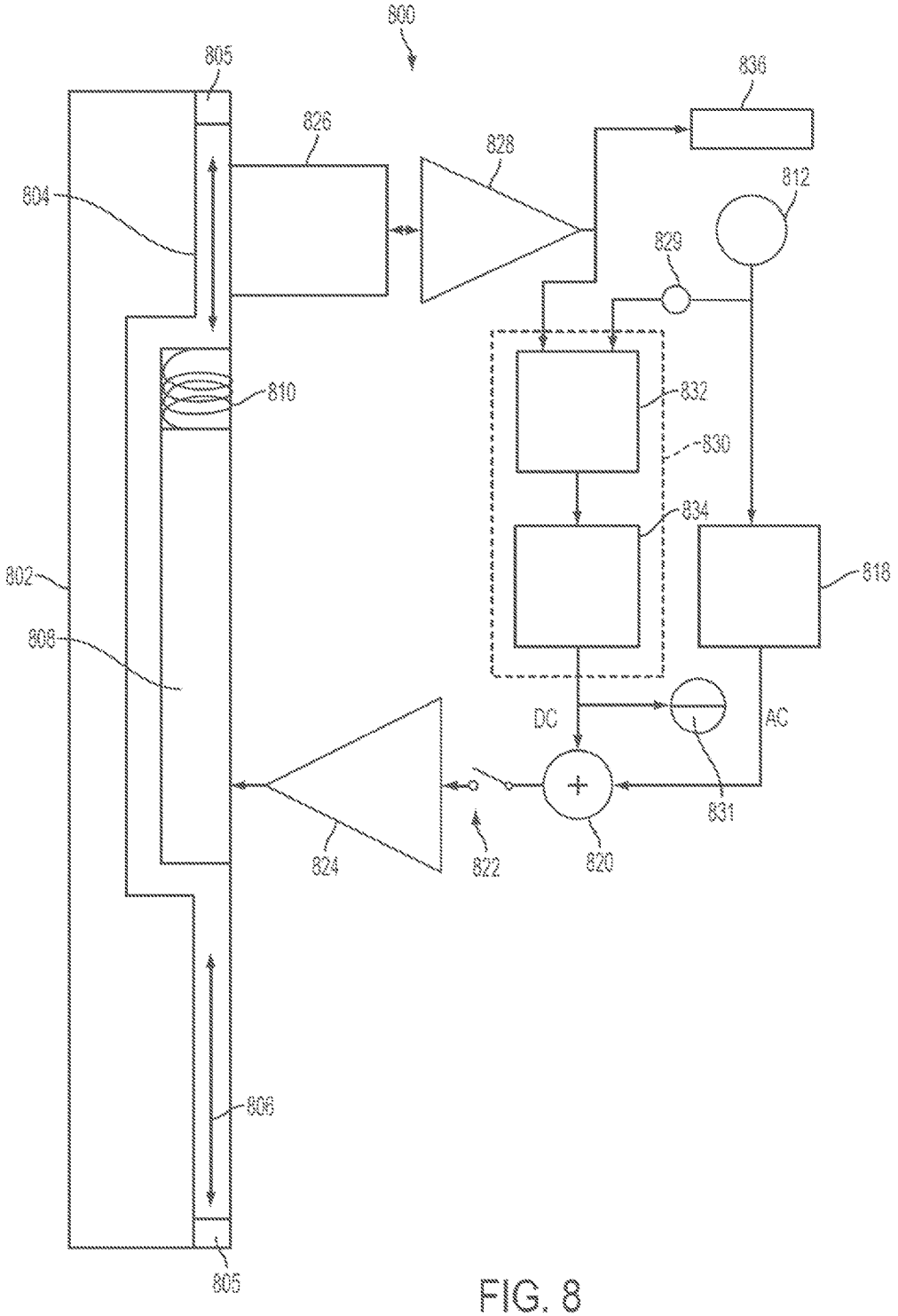
FIG. 8 is a schematic system diagram of a magnetostrictive transducer having a feedback control loop to automatically adjust the preload force in a magnetostrictive transducer, where the magnetostrictive core is non-magnetized, according to some aspects of the present disclosure.

FIG. 8 is a schematic system diagram 800 of a magnetostrictive transducer 808 having a feedback control loop to automatically adjust the preload force in a magnetostrictive transducer 808, where the magnetostrictive core is non-magnetized. As described above using a magnetized magnetostrictive core, a magnetostrictive transducer 808 having a non-magnetized magnetostrictive core according to the present disclosure can be mounted on a tubular member of a tool string to provide for an acoustic communication channel along a length of the tubular member. In one exemplary application, the tool string to which the magnetostrictive transducer 808 is mounted can be a drill string, that in part includes a drill string motor. A drill string motor region 802 is a section of the overall drill string where functional components of the drill string motor region 802 preclude the use of signal communication by elements such as wireline or slickline connections. A drill collar 804 is mounted over the drill string motor region 802, or is constructed as part of the casing of the drill string motor region 802. The drill collar 804 is further constructed to have a pocket or a cavity that can encase, hold, or support the magnetostrictive transducer 808. The drill collar 804 cavity for the magnetostrictive transducer 808 can be oriented on either the exterior or interior side of the drill collar 804. A preload spring 810 is located within the drill collar cavity 804, exerting at least a part of a preload force on the magnetostrictive transducer 808. When the magnetostrictive transducer 808 extends in length, the magnetostrictive transducer 808 applies longitudinal pressure on the drill collar 804, resulting in acoustic waves 806, that travel along the length of the drill collar. The drill collar 804 can further include a resonant acoustic cavity 805 at both the upper and lower end of the drill collar 804. The resonant acoustic cavities 805 can have a different density or elastic modulus than the drill collar 804, and can provide for acoustic discontinuities in the drill collar 804 that can concentrate the power of the fundamental frequency of the acoustic waves 806.

The magnetostrictive transducer 808 converts electrical signals into acoustic signals, and receives electrical signals from both a filtered sensory signal input and a control loop feedback signal. Initially, a carrier signal (alternatively referred to as a sensory signal) is received by an oscillator 812 from a sensor, located elsewhere on the drill string. In various aspects, the oscillator 812 can provide a sine wave signal, a square wave signal, or a signal with another form, shape, or frequency, or a combination thereof. The oscillator 812 can pass the carrier signal at the frequency at which the carrier signal is received from the sensor. Thus, for example, a carrier signal frequency of 500 Hz is passed at 500 Hz by the oscillator 812. The oscillator 812 delivers the carrier signal to both of a low-pass filter 818 and a detector module 830. Generally, the signal produced by the oscillator 812 is referred to as a reference signal. In some aspects, the oscillator 812 can be used for bidirectional applications allowing the magnetostrictive transducer 808 system to both supply and receive a signal.

For the non-magnetized magnetostrictive transducer 808 system, the acoustic waves 806 are rectified sine waves. The use of rectified sine waves provides for a benefit in the power consumption of a connected sensor. In many applications, the sensor delivering a substantive carrier signal to the magnetostrictive transducer 808 is a battery-powered sensor. The rectification of the received signal doubles the power of the received carrier signal that passes through the magnetostrictive transducer 808. Thus, the sensor can be configured to emit signals at a power level that is half of what would otherwise be necessary to transmit the signal through the magnetostrictive transducer 808 system. The operational life of a battery-powered sensor can thereby be extended. Further, the rectification of the carrier signal can remove components of the carrier frequency in the acoustic waves 806 generated by the magnetostrictive transducer 808, such that the acoustic waves 806 accurately double the frequency of the original carrier signal.

The oscillator 812 passes the carrier signal to the low-pass filter 818, where the low-pass filter 818 can produce a sine wave output signal at the same frequency as the carrier signal, removing aspects of the signal outside the filter range, and without introducing phase shifts. In some aspects, the low-pass filter 818 can be a Bessel filter. The sinusoidal signal output by the low-pass filter 818 can be referred to as a filtered carrier signal. The filtered carrier signal is delivered to an additive function 820 where the filtered carrier signal is added to a corrective signal. The additive function 820 delivers the combined filtered carrier signal and corrective signal to a power amplifier 824 across a modulation switch 822. The modulation switch 822 can actuate between an open and closed position, allowing for continuous, pulsed, or intermittent delivery of signal to the power amplifier 824.

The power amplifier 824 produces an amplified carrier signal, the drive signal, which is delivered to and drives the magnetostrictive transducer 808. In some aspects, the power amplifier 824 can be a linear amplifier. The magnetostrictive transducer 808 includes a coil wrapped around a magnetized magnetostrictive core, where the amplified input signal enters the coil and thereby causes the magnetostrictive core, and thus the magnetostrictive transducer 808, to expand or contract. Due to the fact that the magnetostrictive core of the magnetostrictive transducer 808 is non-magnetized, the AC signal received from the low-pass filter 818 through the power amplifier 824 will cause the mechanical oscillation of the magnetostrictive transducer 808 to be a full-wave rectification of the carrier signal, thereby doubling the frequency of the signal output by the magnetostrictive transducer 808. In other words, the magnetostrictive transducer 808 is not subjected to priming magnetization or preload force to move the working point up the transfer characteristic of the magnetostrictive core. Rather, from a baseline working point the magnetostrictive core expands proportionally to the power of the signal received through the power amplifier 824, stretching regardless of the polarity of that signal. The control loop for the non-magnetized magnetostrictive transducer 808 operates to maintain a baseline working point with zero coercive magnetic force, allowing for the magnetostrictive transducer 808 to produce longitudinal pressure and acoustic waves 806 at twice the received carrier signal frequency.

In aspects, the drill collar 804 can be constructed to minimize the amount of phase shift and concentrate the power of the fundamental frequency of acoustic waves 806 that pass through the drill collar 804. In particular, resonant acoustic cavities 805 on the upper and lower ends of the drill collar 804 can provide acoustic discontinuities in the drill collar 804 that reflect the acoustic waves 806 to concentrate the power of the acoustic waves 806 fundamental. The resonant acoustic cavities 805 should have a length that is about half the wavelength of the acoustic waves 806 such that any energy from the acoustic waves 806 that passes into and returns from the resonant acoustic cavities 805 is constructive interference to and in phase with the acoustic waves 806. The speed of sound in any medium is given by: $C=\sqrt{(E/\sigma)}$, where C is the speed (m/s), E is the bulk modulus (Pascals) of a given material, and σ is the density (kg/meter$^3$) of the given material. For example, in a drill collar 804 constructed from steel, the speed of sound in steel is approximately 5000 m/s, thus a resonant acoustic cavity 805 having a corresponding half-wavelength length would be 2.5 meters long.

As the magnetostrictive transducer 808 expands and exerts pressure on the drill collar 804, acoustic waves 806 travel along the length of the drill collar 804 and are received by an acoustic telemetry receiver 826. In some aspects, the acoustic telemetry receiver 826 can be an accelerometer. The acoustic telemetry receiver 826 converts the signal based on the acoustic waves 806 by generating analogue electric signals. The electric signals produced by the acoustic telemetry receiver 826 are delivered to a charge amplifier 828. The charge amplifier 828 produces a corresponding output signal which is delivered to both the detector module 830 and a processing receiver 836. The combination of the acoustic telemetry receiver 826 and charge amplifier 828 can have a sufficient dynamic range to account for drilling vibration, ranges of motion for the internal components of the acoustic telemetry receiver 826 and charge amplifier 828 such that the combination does not provide output signal based on vibration alone. The output signal should correspond to the carrier signal initially received by the oscillator 812, and thereby provide data corresponding to the carrier signal from the sensor to the processing receiver 836.

The detector module 830 can include a phase detector 832 and an integrator 834, where the detector module 830 receives two signal inputs, the reference signal from the oscillator 812 and the output signal from the charge amplifier 828. The phase detector 832 receives both the reference signal from the oscillator 812 and the output signal from the charge amplifier 828 and can use those signals to determine and produce a voltage difference between the signals. In other words, the phase detector 832 can correlate the second order harmonic of the output signal with the reference signal from the oscillator 812. Where the reference signal from the oscillator 812 is the carrier signal, the reference signal represents a sub-harmonic of the output signal. The difference between the sub-harmonic reference signal and output signal determined by the phase detector 832 thus represents interference in the output signal. The signal produced by the phase detector 832 a series of pulses with a DC component, proportional to the level of second harmonic in the output signal and also proportional to the phase of the output signal. In some aspects, phase detector 832 can be an analogue multiplier or a multiplication operation within a DSP chip.

The signal produced by the phase detector 832 is passed through an integrator 834, which can be a low-pass filter. The signal produced by the integrator 834 and the detector module 830 is a DC signal, referred to as the corrective signal, and sets the bandwidth of the feedback loop signal. The integrator 834 can be set to have a long time constant which can set the loop bandwidth, and which can be set to have a sufficiently narrow range to reject signal other than the carrier signal interference, such as from drilling or vibration noise. The corrective signal is provided to the additive function 820 and combined with the filtered carrier signal. If the working point of the magnetostrictive transducer 808 drifts due to changing stresses on the magnetostrictive transducer, then the two halves of the waveform over the acoustic waves 806 period will no longer be equal. This inequivalence thus re-introduces a component of the carrier frequency. The component of the carrier frequency is passed through the detector module 830 as part of the feedback loop signal, and is provided as a DC corrective signal. The corrective signal is passed the coil magnetostrictive transducer 808 to return the working point of the magnetostrictive core to a baseline working point (i.e., zero strain). Because the corrective signal component of the amplified input signal that drives the magnetostrictive transducer 808 is a DC signal, the resulting strain (expansion or contraction) of the magnetostrictive transducer 808 is maintained for as long as the corrective signal is provided. Concurrently, the AC component of the amplified input signal from the low-pass filter 818 continues to cause the magnetostrictive transducer 808 to strain about the baseline working point. In aspects, filtered carrier signal can be referred to as a first component of a drive signal and the corrective DC signal can be referred to as a second component of the drive signal.

Using a single phase detector 832 as illustrated, it is advisable to minimize any phase shifts of signal passing through the feedback control loop. To reduce potential phase shifts, the acoustic telemetry receiver 826 can be mounted adjacent to the magnetostrictive transducer 808 to minimize any mechanical phase shift. To further reduce potential phase shifts, the low-pass filter 818 can be a filter type having a constant group delay. In some aspects, acoustic telemetry receiver 826 can include a shift-sensing transducer, such as a piezoelectric transducer or a MEMS transducer. The shift-sensing transducer can examine the longitudinal pressure waves induced into the drill collar and shift the phase of the received wave to maintain an operational frequency for the feedback control loop. The shift-sensing transducer has sufficient bandwidth to pass the second order harmonic of the transmission frequency in the process of keeping phase shifts small. In other aspects, if phase delays cannot be sufficiently minimized, a phase shift 829 can be placed in between the oscillator 812 and detector module 830 to shift the reference frequency in order to compensate for the phase shift in the output signal. The phase shift 829 can be controlled and adjust the reference frequency with a DSP implementation of the feedback control loop.

The output signal from the charge amplifier 828 can be pulse modulated by opening and closing the modulation switch 822. Pulse modulation can allow the automatic feedback control loop to settle at the baseline working point, where once the loop reaches a steady-state, there be little if any change or disturbance in the working point between pulses because the sub-harmonic signal will disappear in between pulses based on the actuation of the modulation switch 822. At baseline working point, the signal produced by the phase detector 832 is zero, the integrator 834 output stabilizes, and the corrective signal from the detector module 830 also becomes zero, such that the amplified input signal has no DC component.

A stress sensor 831 can be positioned to measure the DC corrective signal output by the integrator 834. The DC corrective signal output, for a non-magnetized magnetostrictive transducer 808, is a useful diagnostic measurement indicative of weight on the drill collar 804. As the weight on a drill collar 804 increases, the length of the drill collar 804 is compressed and thereby causes a change in the acoustic waves 806. The DC corrective signal output thus in part reflects of the change in length of the drill collar 804, from which a calculation of the weight on the drill collar can be made.

The processing receiver 836 can be a non-transitory computer-readable medium, having programming instructions to evaluate, process, relay, transmit, or otherwise modify or manipulate signal data received through a magnetostrictive transducer 808. The processing receiver 836 can be located downhole along a drill sting or at the surface of a well system coupled to the drill string. In some aspects, the processing receiver 836 can be further coupled to a control unit having an interface to allow for an operator to monitor received output signal and to alter operation of the drill string based upon the received output signal. In other aspects, the processing receiver 836 can be further coupled to a control unit having a set of automatic processing instructions to alter operation of the drill string based upon the received output signal.

Figures 1, 9:
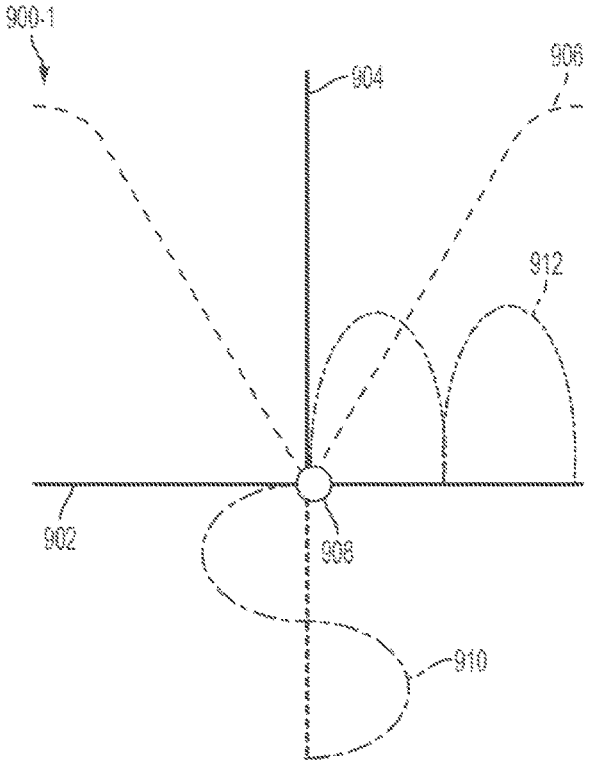
Figures 2, 9:
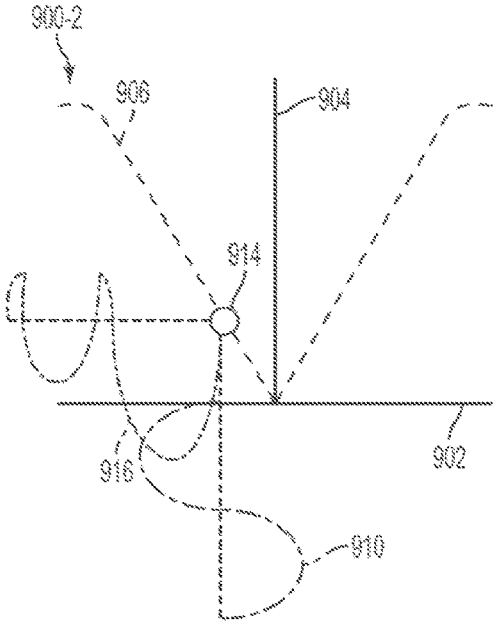
Figures 3, 9:
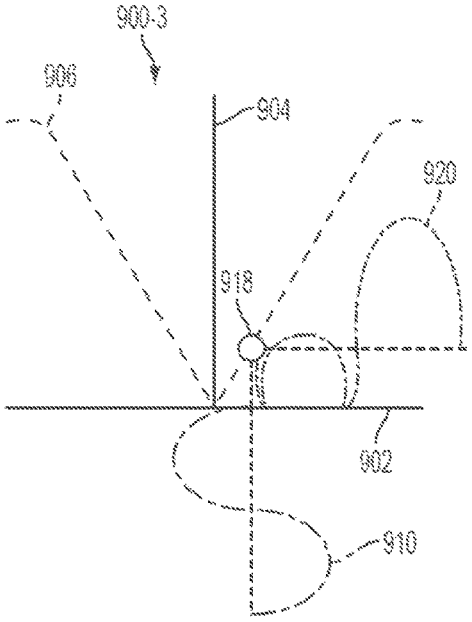

FIG. 9-1 is a graph 900-1 of the strain response of a non-magnetized magnetostrictive core in response to a coercive force from a magnetic field, with a preload force acting on the magnetostrictive core to set the magnetostrictive core at a baseline working point. The graph 900-1 plots the coercive force 902 of a magnetic field against the strain extension 904 of a magnetostrictive core, and further plots the transfer characteristic 906 of a magnetostrictive core under strain (as described in FIG. 5). The graph 900-1 shows that a magnetostrictive core with no preload force has a working point where there is no magnetic coercive force and the length of the magnetostrictive core has zero strain extension, referred to as the baseline working point 908. Under conditions as illustrated in graph 900-1, with an input sinusoidal electrical drive signal 910 (delivered through a coil wrapped around the magnetostrictive core), the strain response 912 of the magnetostrictive core extends proportionally to the amplitude of the drive signal 910, regardless of the polarity of the drive signal 910. The strain response 912 is thereby analogous to a full-wave rectification of the drive signal 910. In other words, the mechanical frequency of the magnetostrictive core expansion and contraction becomes twice the frequency of the electrical drive signal 910. For aspects of the present disclosure having a non-magnetized magnetostrictive core, the increased frequency allows for a stronger signal to be sent by a magnetostrictive transducer due to the increased strength of the transducer output signal resulting from the doubled frequency.

FIG. 9-2 is a graph 900-2 of the strain response of a non-magnetized magnetostrictive core in response to a coercive force from a magnetic field, where the working point has shifted in the direction of the negative magnetic field axis, such that the magnetostrictive core is biased along the transfer characteristic away from a baseline working point. Where working point has shifted to a negative-bias working point 914, the two halves of the negative-bias strain response 916 waveform will be unequal. In particular, the negative-bias strain response 916 waveform will be clipped, limited, dampened, or reverse in direction as the magnetostrictive core extends into the saturation region of the transfer characteristic or contracts to the minimum length of the magnetostrictive core. Where the resulting asymmetric waveform is unequal, a portion of the unrectified drive signal 910 can be reintroduced into the negative-bias strain response 916.

FIG. 9-3 is a graph 900-3 of the strain response of a non-magnetized magnetostrictive core in response to a coercive force from a magnetic field, where the working point has shifted in the direction of the positive magnetic field axis, such that the magnetostrictive core is biased along the transfer characteristic away from a baseline working point. Where working point has shifted to a positive-bias working point 918, the two halves of the positive-bias strain response 920 waveform will be unequal. In particular, the positive-bias strain response 920 waveform will be clipped, limited, dampened, or reverse in direction as the magnetostrictive core extends into the saturation region of the transfer characteristic or contracts to the minimum length of the magnetostrictive core. Where the resulting asymmetric waveform is unequal, a portion of the unrectified drive signal 910 can be reintroduced into the positive-bias strain response 920.

As seen in FIGS. 9-1 through 9-3, operation of a magnetostrictive transducer with a non-magnetized magnetostrictive core at a working point other than the baseline working point 908 can lead to strain responses of the magnetostrictive core (and thus of the magnetostrictive transducer) that do not accurately reflect the amplitude, frequency, or phase of a rectified input electrical drive signal 910. The feedback control loop as shown in FIG. 8 provides for a system to detect any such negative-bias or positive-bias offset of the working point, applying a DC correction to the drive signal 910 to shift the working point back to a baseline working point 908.

Figure 10:
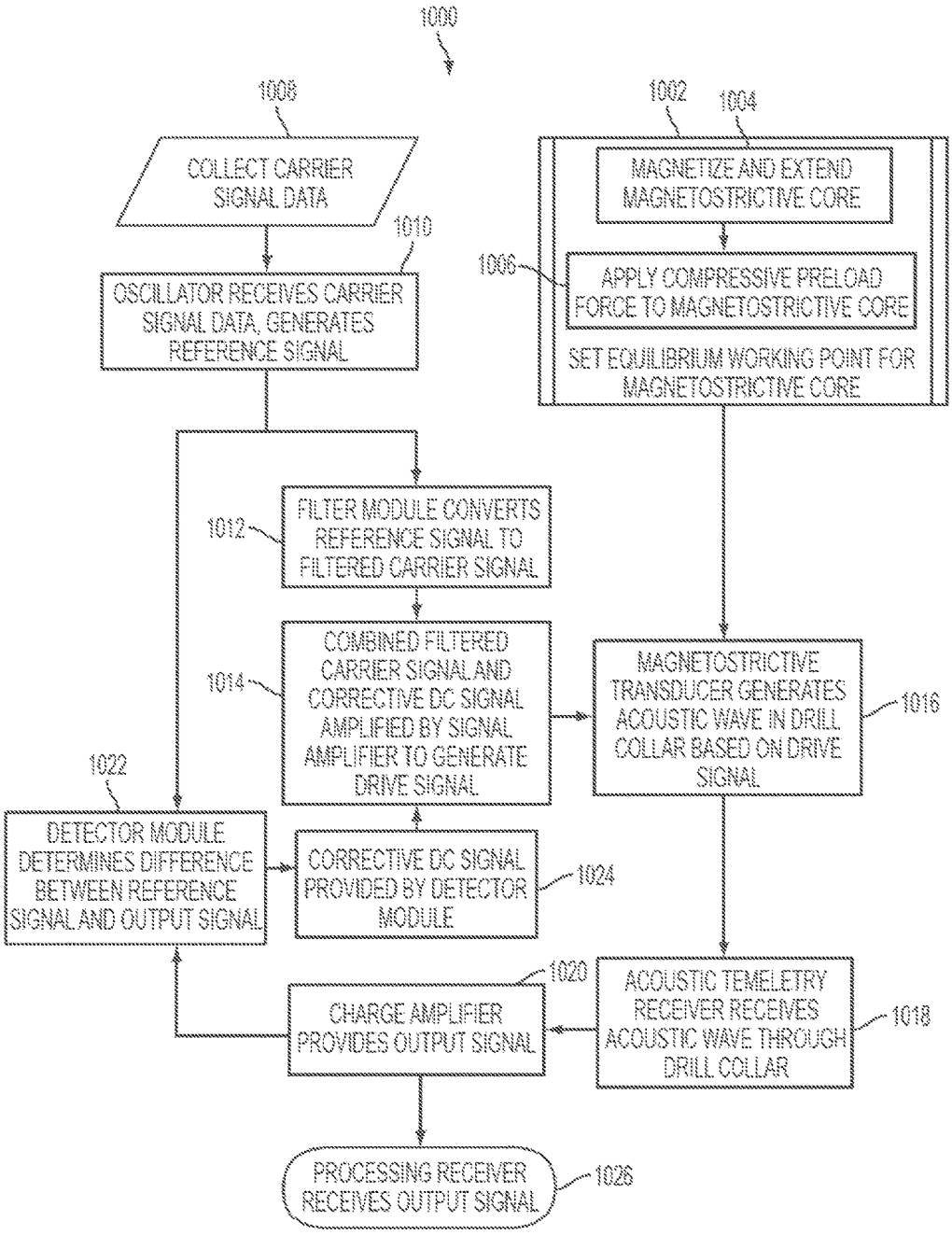
FIG. 10 is a flowchart describing a feedback control loop process for a magnetostrictive transducer with a magnetized magnetostrictive core, according to some aspects of the present disclosure.

FIG. 10 is a flowchart 1000 describing a feedback control loop process for a magnetostrictive transducer system having a magnetized magnetostrictive core. At step 1002, the magnetostrictive core of the magnetostrictive transducer is set to an equilibrium working point. At step 1004, the magnetostrictive core is magnetized to extend in length, where the strain of the magnetostrictive core can be within a linear region of strain of a saturation region of strain for the magnetostrictive core. At step 1006, a compressive preload force is applied to the magnetized magnetostrictive core such that the length of the magnetized magnetostrictive core is at an equilibrium working point within the linear region of strain for the magnetostrictive core. In many aspects, the equilibrium working point for the magnetostrictive core is at the half-point of the linear region of strain for the magnetostrictive core. The compressive preload force can be either or both of a physical preload force from a spring and a magnetic preload force from a permanent magnet oriented to have a flux in a direction opposite to the direction of strain extension of the magnetostrictive core. Concurrently or subsequently, at step 1008, carrier signal data is acquired from a sensor electronically coupled to the magnetostrictive transducer. At step 1010, an oscillator of the magnetostrictive transducer system receives the carrier signal data and generates a reference signal based on the carrier signal, and provides the carrier signal to both a filter module and a detector module. In many aspects, the reference signal has a frequency that is double the frequency of the carrier signal. At step 1012, the filter module receives the reference signal and converts the reference signal to be a filtered carrier signal. The filter module can include a division function to reverse any function the oscillator performed on the on frequency of the carrier signal. The filter module can further include a low-pass filter to isolate a desired range or bandwidth of frequency to pass out of the filter module. In many aspects, the filtered carrier signal is a sinusoidal AC signal. At step 1014, the filtered carrier signal and a corrective DC signal are combined and then amplified by a signal amplifier, which provides the amplified combined signal, a drive signal, to the magnetostrictive transducer.

At step 1016, the magnetized magnetostrictive core receives the drive signal and expands or contracts in response to the drive signal. In aspects where the strain expansion causes the magnetized magnetostrictive core to push against a drill collar (in which the magnetized magnetostrictive core is mounted), the magnetostrictive transducer generates acoustic waves (i.e., longitudinal pressure waves) in the drill collar proportional to the drive signal. At step 1018, acoustic waves that pass through the drill collar are received by an acoustic telemetry receiver, which transduces the physical waves back to an electric signal, and passes the resulting signal to a charge amplifier. At step 1020, the charge amplifier amplifies the signal received from the acoustic telemetry receiver and provides an output signal to both a processing receiver and the detector module. At step 1022, the detector module determines the difference between the reference signal received from the oscillator and the output signal received from the charge amplifier, resulting in a DC signal indicative of offset in the output signal that is a harmonic of the carrier signal. In some aspects, the detector module can include a phase detector and a low-pass filter. At step 1024, the DC signal determined by the detector is provided as a corrective DC signal, in combination with the filtered carrier signal from the filter module, to the signal amplifier. The corrective DC signal, when provided to the magnetostrictive transducer, can cause a strain and shift the working point of the magnetostrictive core, separate from any strain oscillation caused by the AC filtered carrier signal. Where the corrective DC signal is indicative of harmonic offset in the output signal, the strain caused by the corrective DC signal can return the magnetostrictive core to an equilibrium working point. The corrective DC signal thereby automatically adjusts the preloading force on the magnetized magnetostrictive core. At step 1026, a processing receiver receives the output signal from the charge amplifier, and can further process, transmit, relay, or otherwise manipulate the output signal for evaluation and analysis.

Figure 11:
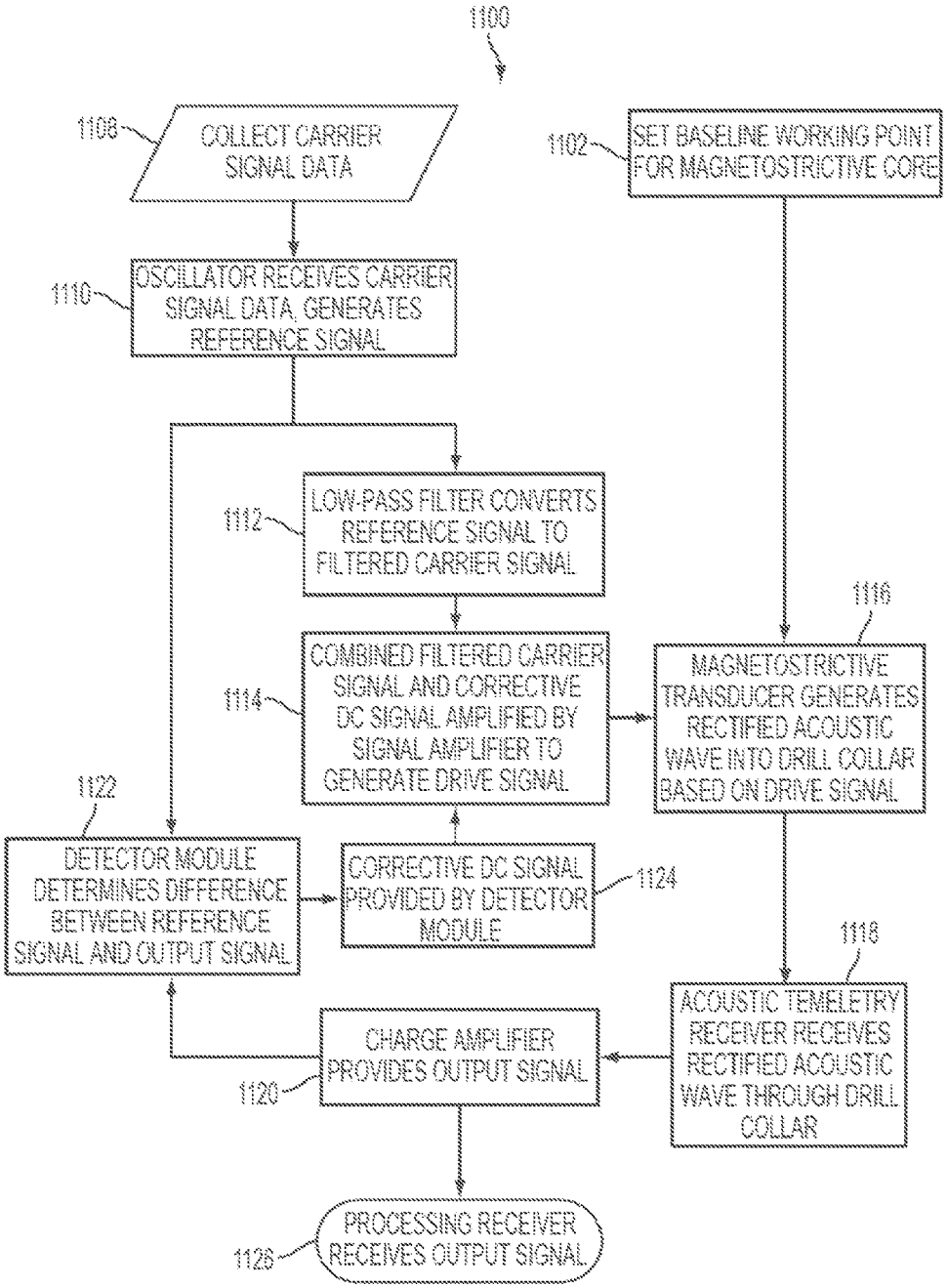
FIG. 11 is a flowchart describing a feedback control loop process for a magnetostrictive transducer with a non-magnetized magnetostrictive core, according to some aspects of the present disclosure.

FIG. 11 is a flowchart 1100 describing a feedback control loop process for a magnetostrictive transducer system having a non-magnetized magnetostrictive core. At step 1102, the magnetostrictive core of the magnetostrictive transducer is set to a baseline working point, which in some aspects can be the minimum length of the magnetostrictive core when not subjected to any strain. In some aspects, setting the baseline working point can include the application of a physical compressive preload force from either or both of a physical preload force from a spring and a magnetic preload force from a permanent magnet oriented to have a flux in a direction opposite to the direction of strain extension of the magnetostrictive core. Concurrently or subsequently, at step 1108, carrier signal data is acquired from a sensor electronically coupled to the magnetostrictive transducer. At step 1110, an oscillator of the magnetostrictive transducer system receives the carrier signal data and generates a reference signal based on the carrier signal, and provides the carrier signal to both a low-pass filter and a detector module. In many aspects, the reference signal has a frequency that is equal to the frequency of the carrier signal. At step 1112, the low-pass filter receives the reference signal and converts the reference signal to be a filtered carrier signal which can isolate a desired range or bandwidth of frequency to pass as a sinusoidal AC signal. At step 1114, the filtered carrier signal and a corrective DC signal are combined and then amplified by a signal amplifier, which provides the amplified combined signal, a drive signal, to the magnetostrictive transducer.

At step 1116, the non-magnetized magnetostrictive core receives the drive signal and expands in response to the drive signal. In aspects where the strain expansion causes the non-magnetized magnetostrictive core to push against a drill collar (in which the magnetostrictive core is mounted), the magnetostrictive transducer generates acoustic waves in the drill collar proportional to double the frequency of the drive signal, i.e., a full-wave rectification of the carrier signal. At step 1118, acoustic waves that pass through the drill collar are received by an acoustic telemetry receiver, which transduces the physical waves back to an electric signal, and passes the resulting signal to a charge amplifier. At step 1120, the charge amplifier amplifies the signal received from the acoustic telemetry receiver and provides an output signal to both a processing receiver and the detector module. At step 1122, the detector module determines the difference between the reference signal received from the oscillator and the output signal received from the charge amplifier, resulting in a DC signal indicative of offset in the output signal that is representative of the original carrier signal as opposed to a full-wave rectification of the carrier signal. In some aspects, the detector module can include a phase detector and a low-pass filter. At step 1124, the DC signal determined by the detector is provided as a corrective DC signal, in combination with the filtered carrier signal from the filter module, to the signal amplifier. The corrective DC signal, when provided to the magnetostrictive transducer, can cause a strain and shift the working point of the magnetostrictive core, separate from any strain oscillation caused by the AC filtered carrier signal. Where the corrective DC signal is indicative of offset in the output signal, the strain caused by the corrective DC signal can return the magnetostrictive core to a baseline working point. The corrective DC signal thereby automatically adjusts the preloading force on the non-magnetized magnetostrictive core. At step 1126, a processing receiver receives the output signal from the charge amplifier, and can further process, transmit, relay, or otherwise manipulate the output signal for evaluation and analysis.

In some aspects, the present disclosure is directed toward a magnetostrictive transducer system having a magnetized magnetostrictive transducer mechanically coupled to a tubular member, the magnetized magnetostrictive transducer arranged to strain in response to a drive signal and thereby produce a corresponding acoustic wave in the tubular member; a preload spring, positioned between and in contact with the tubular member and the magnetized magnetostrictive transducer, applying a preload force on the magnetized magnetostrictive transducer; an oscillator that is receptive to a carrier signal and drives a reference signal that is proportional to the received carrier signal; a filter module that is receptive to the reference signal, filters the carrier signal, and provides a filtered carrier signal to the magnetized magnetostrictive transducer, where the filtered carrier signal is a first component of the drive signal; a detector module that is receptive to the reference signal and an output signal, and provides a corrective DC signal as a feedback to the magnetized magnetostrictive transducer, where the corrective DC signal is a second component of the drive signal, and where the corrective DC signal automatically adjusts the strain of the magnetized magnetostrictive transducer; and an acoustic telemetry receiver mechanically coupled to the tubular member that senses acoustic waves in the tubular member and transduces corresponding electrical signals to provide the output signal to the detector module. In particular aspects, the tubular member construction includes, in part, a drill collar. In some such aspects, the filter module of the magnetostrictive transducer can include a divide-by-two function and a low-pass filter, where the filtered carrier signal can be a sinusoidal signal. In other aspects, the detector module of the magnetostrictive transducer can include a phase detector and an integrator. In further aspects, the magnetostrictive transducer system can further include a signal amplifier that is receptive to the filtered carrier signal and the corrective DC signal, and provides an amplified combination of the filtered carrier signal and the corrective DC signal as the drive signal. In some aspects, the magnetostrictive transducer can further include a charge amplifier coupled to the acoustic telemetry receiver that amplifies the electrical signals provided the by acoustic telemetry receiver and provides the output signal. In other aspects, the magnetostrictive transducer system can further include a processing receiver that is receptive to the output signal. In further aspects, the magnetostrictive transducer can further include a permanent magnet having a flux in a direction parallel to the preload force applied by the preload spring. In some aspects of the magnetostrictive transducer system, the reference signal can be a second order harmonic of the carrier signal. In other aspects of the magnetostrictive transducer system, the corrective DC signal can be indicative of second order harmonics of the carrier signal. In other aspects of the magnetostrictive transducer system, the output signal can be an analog of the carrier signal.

In other aspects, the present disclosure is directed toward a magnetostrictive transducer system having a non-magnetized magnetostrictive transducer mechanically coupled to a tubular member, the non-magnetized magnetostrictive transducer arranged to strain in response to a drive signal and thereby produce an acoustic wave in the tubular member, where the acoustic wave is a full-wave rectification of the drive signal; a preload spring, positioned between and in contact with the tubular member and the non-magnetized magnetostrictive transducer, applying a preload force on the non-magnetized magnetostrictive transducer; an oscillator that is receptive to a carrier signal and drives a reference signal that is proportional to the received carrier signal; a low-pass filter that is receptive to the reference signal, filters the carrier signal, and provides a filtered carrier signal to the non-magnetized magnetostrictive transducer, where the filtered carrier signal is a first component of the drive signal; a detector module that is receptive to the reference signal and an output signal, and provides a corrective DC signal as a feedback to the non-magnetized magnetostrictive transducer, where the corrective DC signal is a second component of the drive signal, and where the corrective DC signal automatically adjusts the strain of the non-magnetized magnetostrictive transducer; and an acoustic telemetry receiver mechanically coupled to the tubular member that senses acoustic waves in the tubular member and transduces corresponding electrical signals to provide the output signal to the detector module. In particular aspects, the tubular member construction includes, in part, a drill collar In some such aspects, the filtered carrier signal of the magnetostrictive transducer system can be a sinusoidal signal. In other aspects, the detector module of the magnetostrictive transducer system can include a phase detector and an integrator. In further aspects, the magnetostrictive transducer system can further include a signal amplifier that is receptive to the filtered carrier signal and the corrective DC signal, and can provide an amplified combination of the filtered carrier signal and the corrective DC signal as the drive signal. In some aspects, the magnetostrictive transducer system can further include a charge amplifier coupled to the acoustic telemetry receiver that amplifies the electrical signals provided by the acoustic telemetry receiver and provides the output signal. In other aspects, the processing receiver of the magnetostrictive transducer can be receptive to the output signal. In further aspects, the magnetostrictive transducer can further include a permanent magnet having a flux in a direction parallel to the preload force applied by the preload spring. In some aspects, the reference signal of the magnetostrictive transducer can be a sub-harmonic of the carrier signal. In other aspects, the corrective DC signal of the magnetostrictive transducer system can be indicative of the carrier signal frequency. In further aspects, the output signal of the magnetostrictive transducer system can be an analog of the twice the frequency of the carrier signal.

Further aspects of the present disclosure are directed to a method of transducing a signal through a tubular member which can include the steps of: setting a working point for a magnetostrictive core mechanically coupled to the tubular member; collecting and filtering a carrier signal to generate a filtered carrier signal; combining the filtered carrier signal with a corrective signal to generate a drive signal; delivering the drive signal to the magnetostrictive core, causing the magnetostrictive core to change in length and generate an acoustic signal in the tubular member; and receiving the acoustic signal with a telemetry receiver, the telemetry receiver providing an output signal and a feedback to automatically adjust the corrective signal. In some implementations, the method can include providing the carrier signal to an oscillator that generates a reference signal, where the reference signal is then filtered to generate the filtered carrier signal. In further implementations, corrective signal can be determined from a difference between the output signal and the reference signal. In other implementations, the method can include amplifying the drive signal before it is delivered to the magnetostrictive core. In implementations having a magnetizing magnetostrictive core, magnetizing the magnetostrictive core and applying a preload force to the magnetostrictive core can set the working point for the magnetostrictive core. In implementations having a non-magnetized magnetostrictive core, the and method can include the magnetostrictive core generating a rectified acoustic signal in the tubular member.

The subject matter of aspects and examples of this patent is described here with specificity to meet statutory requirements, but this description is not necessarily intended to limit the scope of the claims. The claimed subject matter may be embodied in other ways, may include different elements or steps, and may be used in conjunction with other existing or future technologies. Throughout this description for the purposes of explanation, numerous specific details are set forth in order to provide a thorough understanding of examples and aspects of the subject matter disclosed herein. It will be apparent, however, to one skilled in the art that the many examples or aspects may be practiced without some of these specific details. In some instances, structures and devices are shown in diagram or schematic form to avoid obscuring the underlying principles of the described examples or aspects. This description should not be interpreted as implying any particular order or arrangement among or between various steps or elements except when the order of individual steps or arrangement of elements is explicitly described.

With these aspects in mind, it will be apparent from this description that aspects of the described techniques may be embodied, at least in part, in software, hardware, firmware, or any combination thereof. It should also be understood that aspects can employ various computer-implemented functions involving data stored in a data processing system. That is, the techniques may be carried out in a computer or other data processing system in response executing sequences of instructions stored in memory. In various aspects, hardwired circuitry may be used independently, or in combination with software instructions, to implement these techniques. For instance, the described functionality may be performed by specific hardware components, such as a control unit for actuating a modulation switch of a magnetostrictive transducer system, driving an oscillator to produce a specific reference signal, or magnetizing a magnetostrictive element. Such a control unit can contain hardwired logic for performing operations, or any combination of custom hardware components and programmed computer components. The techniques described herein are not limited to any specific combination of hardware circuitry and software.

The foregoing description of the disclosure, including illustrated aspects and examples has been presented only for the purpose of illustration and description and is not intended to be exhaustive or to limit the disclosure to the precise forms disclosed. Numerous different modifications, adaptations, and arrangements of the components depicted in the drawings or described above, as well as components and steps not shown or described, are possible. Similarly, some features and subcombinations are useful and may be employed without reference to other features and subcombinations. Examples and aspects of the subject matter have been described for illustrative and not restrictive purposes, and alternative examples or aspects will become apparent to those skilled in the art without departing from the scope of this disclosure. Accordingly, the present subject matter is not limited to the examples or aspects described above or depicted in the drawings, and various embodiments, examples, aspects, and modifications can be made without departing from the scope of the claims below.

That which is claimed is:

1. A magnetostrictive transducer system comprising:

a magnetostrictive transducer mechanically coupled to a tubular member, the magnetostrictive transducer arranged to strain in response to a drive signal and thereby produce a corresponding acoustic wave in the tubular member;

a preload spring positioned between and in contact with the tubular member and the magnetostrictive transducer to apply a preload force on the magnetostrictive transducer;

an oscillator positioned to receive a carrier signal and to drive a reference signal that is proportional to the received carrier signal;

a filter module positioned to receive the reference signal, to filter the carrier signal, and to provide a filtered carrier signal to the magnetostrictive transducer, where the filtered carrier signal is a first component of the drive signal;

a detector module positioned to receive the reference signal and an output signal and to provide a corrective DC signal as a feedback to the magnetostrictive transducer, where the corrective DC signal is a second component of the drive signal, for automatic adjustment to the strain of the magnetostrictive transducer; and an acoustic telemetry receiver mechanically coupled to the tubular member to sense acoustic waves in the tubular member and to transduce corresponding electrical signals to provide the output signal to the detector module.

2. The magnetostrictive transducer system according to claim 1, wherein the tubular member comprises a drill collar.

3. The magnetostrictive transducer system according to claim 1, wherein the magnetostrictive transducer is magnetized, and wherein the filter module comprises a divide-by-two function and a low-pass filter.

4. The magnetostrictive transducer system according to claim 3, wherein the reference signal is a second order harmonic of the carrier signal.

5. The magnetostrictive transducer system according to claim 4, wherein the corrective DC signal is indicative of second order harmonics of the carrier signal.

6. The magnetostrictive transducer system according to claim 3, wherein the output signal is an analog of the carrier signal.

7. The magnetostrictive transducer system according to claim 1, wherein the magnetostrictive transducer is non-magnetized, and wherein the filter module comprises a low-pass filter.

8. The magnetostrictive transducer system according to claim 7, wherein the acoustic waves produced are a full-wave rectification of the drive signal.

9. The magnetostrictive transducer system according to claim 7, wherein the reference signal is a sub-harmonic of the carrier signal.

10. The magnetostrictive transducer system according to claim 9, wherein the corrective DC signal is indicative of the carrier signal frequency.

11. The magnetostrictive transducer system according to claim 7, wherein the output signal is an analog of the twice the frequency of the carrier signal.

12. The magnetostrictive transducer system according to claim 1, wherein the detector module comprises a phase detector and an integrator.

13. The magnetostrictive transducer system according to claim 1, further comprising a signal amplifier positioned to receive the filtered carrier signal and the corrective DC signal and to provide an amplified combination of the filtered carrier signal and the corrective DC signal as the drive signal.

14. The magnetostrictive transducer system according to claim 1, further comprising a charge amplifier coupled to the acoustic telemetry receiver to amplify the electrical signals provided by the acoustic telemetry receiver and to provide the output signal.

15. The magnetostrictive transducer system according to claim 1, further comprising a processing receiver positioned to receive the output signal.

16. The magnetostrictive transducer system according to claim 1, further comprising a permanent magnet having a flux in a direction parallel to the preload force applied by the preload spring.

17. A method of transducing a signal through a tubular member comprising:

setting a working point for a magnetostrictive core mechanically coupled to the tubular member;

collecting and filtering a carrier signal to generate a filtered carrier signal;

combining the filtered carrier signal with a corrective signal to generate a drive signal;

delivering the drive signal to the magnetostrictive core, causing the magnetostrictive core to change in length and generate an acoustic signal in the tubular member; and receiving the acoustic signal with a telemetry receiver, the telemetry receiver providing an output signal and a feedback to automatically adjust the corrective signal.

18. The method of claim 17, further comprising providing the carrier signal to an oscillator that generates a reference signal, wherein the reference signal is then filtered to generate the filtered carrier signal.

19. The method of claim 18, wherein the corrective signal is determined from a difference between the output signal and the reference signal.

20. The method of claim 17, further comprising amplifying the drive signal delivered to the magnetostrictive core.

21. The method of claim 17, wherein setting the working point for the magnetostrictive core further comprises magnetizing the magnetostrictive core and applying a preload force to the magnetostrictive core.

22. The method of claim 17, wherein the magnetostrictive core is non-magnetized and further comprises the magnetostrictive core generating a rectified acoustic signal in the tubular member.

* * * * *